US010065755B2

(12) United States Patent
Palumbo

(10) Patent No.: US 10,065,755 B2
(45) Date of Patent: Sep. 4, 2018

(54) APPARATUS AND PROCESS FOR PACKAGING A PRODUCT

(71) Applicant: CRYOVAC, INC., Duncan, SC (US)

(72) Inventor: Riccardo Palumbo, Arona (IT)

(73) Assignee: Cryovac, Inc., Charlotte, NC (US)

( * ) Notice: Subject to any disclaimer, the term of this patent is extended or adjusted under 35 U.S.C. 154(b) by 409 days.

(21) Appl. No.: 14/889,766

(22) PCT Filed: May 6, 2014

(86) PCT No.: PCT/EP2014/059196
§ 371 (c)(1),
(2) Date: Nov. 6, 2015

(87) PCT Pub. No.: WO2014/180823
PCT Pub. Date: Nov. 13, 2014

(65) Prior Publication Data

US 2016/0194101 A1 Jul. 7, 2016

(30) Foreign Application Priority Data

May 7, 2013 (EP) ..... 13166773

(51) Int. Cl.

| | |
|---|---|
| ***B65B 31/00*** | (2006.01) |
| ***B65B 11/52*** | (2006.01) |
| ***B65B 25/00*** | (2006.01) |
| ***B65B 31/02*** | (2006.01) |
| ***B65B 47/04*** | (2006.01) |
| ***B65B 57/00*** | (2006.01) |
| ***B65B 61/00*** | (2006.01) |

(Continued)

(52) U.S. Cl.
CPC ..... *B65B 11/52* (2013.01); *B65B 9/04* (2013.01); *B65B 25/001* (2013.01); *B65B 31/00* (2013.01); *B65B 31/021* (2013.01); *B65B 47/02* (2013.01); *B65B 47/04* (2013.01); *B65B 57/00* (2013.01); *B65B 61/005* (2013.01); *B65B 61/06* (2013.01); *B65B 65/003* (2013.01); *B65B 65/02* (2013.01)

(58) Field of Classification Search
CPC ..... B65B 31/021
USPC ..... 53/433
See application file for complete search history.

(56) References Cited

U.S. PATENT DOCUMENTS

| | | | |
|---|---|---|---|
| 3,303,628 | A | 2/1967 | Lovas et al. |
| 3,347,011 | A | 10/1967 | Lovas et al. |
| 3,491,504 | A | 1/1970 | Young et al. |
| 3,574,642 | A | 4/1971 | Weinke |

(Continued)

FOREIGN PATENT DOCUMENTS

| | | | |
|---|---|---|---|
| DE | 2161465 | A1 | 6/1973 |
| DE | 102006022418 | A1 | 11/2007 |

(Continued)

*Primary Examiner* — Lori Baker
(74) *Attorney, Agent, or Firm* — Jon M. Isaacson

(57) ABSTRACT

A process of packaging a product (P) comprising driving at least the precursor body in a machine direction along the operating path, forming into it one or more longitudinal rows of adjacent tray-shaped elements (8), loading one or more of said products (P) into a respective cavity of said tray-shaped elements; forming a through opening at the corner regions of the tray-elements; tightly fixing a plastic film (11) to close the top opening of said tray-shaped elements (8); transversely separating the closed tray-shaped elements forming closed trays. An apparatus (1) for performing the above process is also disclosed.

24 Claims, 12 Drawing Sheets

(51) Int. Cl.

| | |
|---|---|
| ***B65B 61/06*** | (2006.01) |
| ***B65B 65/00*** | (2006.01) |
| ***B65B 65/02*** | (2006.01) |
| ***B65B 9/04*** | (2006.01) |
| ***B65B 47/02*** | (2006.01) |

(56) References Cited

U.S. PATENT DOCUMENTS

| | | | |
|---|---|---|---|
| 3,659,393 | A | 5/1972 | Richter |
| 3,681,092 | A | 8/1972 | Titchenal et al. |
| 3,713,849 | A | 1/1973 | Grindrod et al. |
| 4,055,672 | A | 10/1977 | Hirsch et al. |
| RE30,009 | E | 5/1979 | Perdue et al. |
| 4,777,782 | A | 10/1988 | Nixon et al. |
| 5,346,735 | A | 9/1994 | Logan et al. |
| 5,711,978 | A | 1/1998 | Breen et al. |
| 6,476,137 | B1 | 11/2002 | Longo |
| 8,129,007 | B2 | 3/2012 | Forloni |
| 8,474,226 | B2 | 7/2013 | Izquierdo et al. |
| 2005/0074531 | A1 | 4/2005 | Patterson |
| 2005/0257501 | A1 | 11/2005 | Natterer |
| 2007/0022717 | A1 | 2/2007 | Seggem |
| 2011/0068042 | A1 | 3/2011 | Palumbo |
| 2012/0204516 | A1 | 8/2012 | Palumbo et al. |

FOREIGN PATENT DOCUMENTS

| | | | | |
|---|---|---|---|---|
| EP | 2 287 49 | A1 * | 2/2011 | |
| FR | 1258357 | A | 4/1961 | |
| FR | 1286018 | A | 3/1962 | |
| WO | WO 9714313 | A1 * | 4/1997 | ..... B65B 25/067 |
| WO | 2007131683 | A2 | 11/2007 | |

* cited by examiner

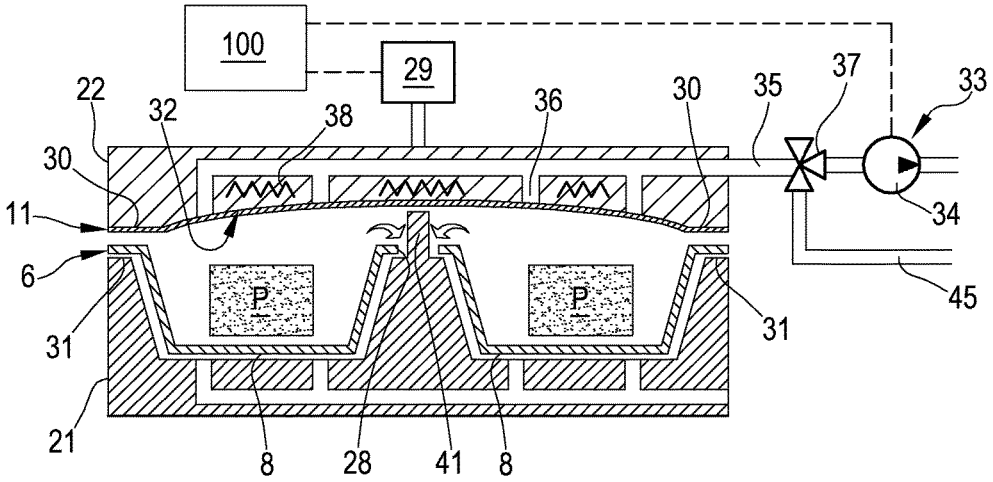
FIG.11
FIG.12
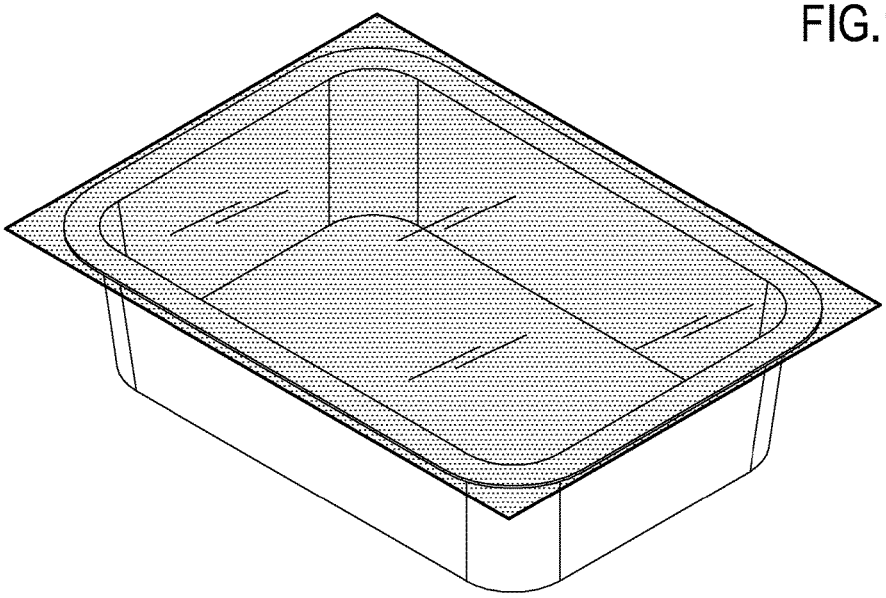

APPARATUS AND PROCESS FOR PACKAGING A PRODUCT

TECHNICAL FIELD

The present invention relates to an apparatus and to a process for packaging of a product. In accordance with certain aspects, the invention relates to an apparatus and process for packaging a product under a controlled atmosphere or under vacuum. In accordance with other aspects the invention relates to an apparatus and process for skin packaging of a product.

BACKGROUND ART

Plastic containers are commonly used for the packaging of food and for a wide variety of other items wherein a plastic lid is bonded to the container e.g. by the application of heat.

In order to package products, in particular food products, vacuum packaging have been developed in the past.

Among the known vacuum packaging processes, vacuum skin packaging is commonly employed for packaging food products such as fresh and frozen meat and fish, cheese, processed meat, ready meals and the like. Vacuum skin packaging is described for instance in FR 1 258 357, FR 1 286 018, AU 3 491 504, US RE 30 009, U.S. Pat. No. 3,574,642, U.S. Pat. No. 3,681,092, U.S. Pat. No. 3,713,849, U.S. Pat. No. 4,055,672, and U.S. Pat. No. 5,346,735.

Vacuum skin packaging is basically a thermoforming process. In particular, the product is typically placed on a rigid or semi-rigid support (such as a tray, a bowl or a cup). The support with the product placed thereon is put in a vacuum chamber, where a film of thermoplastic material, held by vacuum in a position above the product placed on the support, is heated to soften it. The space between the support and the film is then evacuated and finally vacuum above the film is released to cause the film to drape down all around the product and seal to the surface of the support not covered by the product, thus forming a tight skin around the product and on the support.

US 2005/0257501 discloses a machine for packaging a product arranged in a tray. The machine has a lower tool for supporting the tray and an upper tool with a cutting device. During operation, the film is clamped along an edge surrounding the tray and is deformed by the upper tool in a direction extending away the product. The space surrounding the product is then evacuated, the film and the edge of the tray are sealed and the film is then cut by the cutting device.

As to the machines disclosed by US 2007/0022717 and US 2005/0257501, the film is cut to the size of the tray within the chamber formed by the upper tool and the lower tool, by means of the cutting devices provided on the upper tool. First of all, this disadvantageously requires providing a rather complex and bulky upper tool. Besides, this disadvantageously requires providing an excess film with respect to the size of the support, which excess film is cut from the package and scrapped during or at the end of the packaging process. Indeed, the film is in the form of a continuous sheet wound on a roll (as shown e.g. in FIG. 3 of US 2005/0257501). Therefore, an excess film is required to allow the film to be pulled from the roll and to be held in place above the supported product. Further, in US 2007/0022717 more than one product loaded support (namely two) is packaged at each cycle, so that an excess film is also present between adjacent supports.

DE102006022418 discloses a an apparatus where a sealing film is cut to size and fixed to the upper rim of a tray inside the sealing station. This solution requires a quite complex design of the sealing station in order to host and operate the cutting blades. Furthermore, an excess film is required to allow sealing and cutting of the film. Furthermore described in this reference provides for a little tube operating through a valve on the tray side wall or through a gap between the sealing film and the tray upper rim.

WO2011/012652 shows an apparatus for packaging a product in a tray. The machine comprises a first film transfer plate configured for holding a film sheet, heating the film sheet, bringing the film sheet to a position above a tray with the product arranged thereon and air tightly fixing the film sheet to the tray. A second film transfer plate is also present. As for the first film transfer plate also the second film transfer plate is configured for holding a film sheet, heating the film sheet, bringing the film sheet to a position above a tray with the product arranged thereon and air tightly fixing the film sheet to the tray. During a first operating step of the machine, the first film transfer plate holds a first film sheet and heats the first film sheet, while the second film transfer plate releases a second film sheet thereby allowing the second sheet to be drawn into a first tray; and during a second operating step of the machine, the second film transfer plate holds a third film sheet and heats the third film sheet, while the first film transfer plate releases the first film sheet thereby allowing the first film sheet to be drawn into a second tray. The machine further comprises a rotating cylinder suitable for rotating about its axis X, the first film transfer plate and the second film transfer plate being connected to the rotating cylinder so that, when the rotating cylinder rotates about its axis X, the positions of the first film transfer plate and the second film transfer plate are exchanged. A vacuum arrangement allows removing air from within the tray underneath the film sheet (positioned either by the first or by the second film transfer plate) through the hole or holes present in the tray. The film transfer plates are configured to release the film sheet thereby allowing the film sheet to be drawn into the tray while the vacuum arrangement is removing air from within the tray. This solution has allowed significant savings in term of film material, but requires cutting the film to size before the film is sealed to the tray.

Besides the above solutions, packaging apparatus have been developed wherein trays are in-line formed from a continuous bottom web of plastic material. The in-line formed trays, after being filled with an appropriate product, are sealed by a continuous top film. The plurality of sealed trays are then longitudinally and, if necessary transversally, separated by cutters located down stream the sealing station. In this kind of apparatus, the bottom web is perforated in correspondence of the longitudinal side edges thereof. This is done to create apertures which allow air removal from the trays in correspondence of the sealing station, before fixing the top film to the trays. Furthermore, chains provided with grip means guide the bottom web all along its path from formation of the trays up to the final separation. The perforated side edges are removed from the trays and cause a non negligible waste of web and film material.

EP0293794 B1 discloses a packaging apparatus where a continuous sheet of plastic packaging material conveyed by a chain is formed into cup-shaped containers loaded with product and arranged in two side-by-side rows. Evacuation openings are cut through the plastic between successive container pairs: the cuts are located in the middle of the transversal rim connecting two consecutive trays and extend in the cross machine direction. A second continuous web of plastic packaging material is laid down over the first web to cover the filled containers and thereby form packages. An appropriate design of the sealing station allows to withdraw gas from the trays via the openings and to then completely seal the trays. This solution, requires that longitudinally adjacent trays be separated by a sufficiently sized transverse rim, thus causing waste of material. Note that if the tray rims concerned with the openings are not finally trimmed, the packaged try may also present rims having a quite irregular shape.

DE 2161465 show a packaging apparatus where trays are continuously formed from a lower continuous plastic web which is guided to a sealing station. A top sealing film is longitudinally cut and is applied to the rows of trays. The longitudinal cuts allow air withdrawal and, after air withdrawal, are eventually sealed at the packaging assembly. Note that longitudinally cutting the top film before the actual sealing to the tray may compromise the ability to accurately guide the top film and certainly increases complexity of the sealing operation.

In this situation, it is an aim of the present invention to offer a process and an apparatus where trays are formed in-line and at the same time scrap of packaging material is minimized.

A further object is that of offering a process and an apparatus capable of properly guiding the trays and the sealing film such as to reduce if not avoid problems of mis-positioning of the sealing film onto the tray.

Additionally, it is an auxiliary object of the invention conceiving a process and an apparatus which can flexibly operate both for skin packaging and for modified atmosphere packaging.

It is a further aim of the invention that of conceiving a process and an apparatus for packaging products using either heat shrinkable films or non heat shrinkable films.

SUMMARY OF THE INVENTION

One or more of the objects specified above are substantially achieved by a process and by an apparatus according to any one of the appended claims. Aspect of the invention are here below disclosed.

A $1^{st}$ aspect concerns an apparatus for packaging a product (P) in a tray said apparatus comprising:

- a support frame defining an operating path;
- a web supply assembly associated to the support frame and configured to supply a plastic precursor body in the form of a plastic web;
- a driving assembly carried by the support frame and configured for moving at least the precursor body in a machine direction (MD) along the operating path;
- a forming station positioned on the operating path and configured to receive the precursor body in said form of plastic web and form into it a number of cavities;
- a film supply assembly configured to supply a plastic film;
- a packaging assembly also positioned along said operating path and configured to receive said plastic film and said precursor body, wherein the packaging assembly is also configured for fixing the plastic film to close the top opening of said tray-shaped elements;
- a separating assembly positioned along said path downstream from the packaging assembly and configured for at least transversely separating the closed tray-shaped elements and form closed trays;
- a cutting tool acting on the precursor body in correspondence of a zone of the predefined path comprised between the web supply assembly and the packaging assembly, the cutting tool being configured for forming a through opening in the precursor body.

In a $2^{nd}$ aspect according to the $1^{st}$ aspect the forming station is configured to receive the precursor body in said form of plastic web and form into it a number of cavities positioned and shaped such that, downstream from the forming station, the precursor body comprises:

- one or more longitudinal rows of adjacent tray-shaped elements,
- longitudinal bands transversally delimiting each row of tray-shaped elements,
- transverse bands longitudinally delimiting and consecutively joining adjacent tray-shaped elements of a same longitudinal row, the transverse bands and the longitudinal bands also delimiting top openings of the tray-shaped elements and crossing each other at a plurality of cross regions.

In a $3^{rd}$ aspect according to any one of the preceding aspects the cutting tool is configured and positioned to form said through opening or said through openings in correspondence of a side wall of each of said tray-shaped elements.

In a $4^{th}$ aspect according to any one of the preceding aspects from the $2^{nd}$ to the $3^{rd}$ the cutting tool is configured and positioned to form said through opening or said through openings in correspondence at a plurality of said cross regions between the longitudinal and the transverse bands, In a $5^{th}$ aspect according to any one of the preceding aspects the apparatus includes a control unit configured and connected to operate at least said driving assembly, said forming station, said packaging assembly and said cutting tool.

In a $6^{th}$ aspect according to any one of the preceding aspects from the $2^{nd}$ to the $5^{th}$ the forming station is configured for forming said plastic precursor body with two or more parallel rows of tray-shaped elements.

In a $7^{th}$ aspect according to the preceding aspect, each of said tray-shaped elements has a substantially rectangular top opening defined by two longitudinal side walls and two transverse side walls of the tray-shaped elements.

In an $8^{th}$ aspect according to the preceding aspect the transverse bands perpendicularly cross the longitudinal bands delimiting said rectangular top openings such that said cross regions are located in correspondence of corner zones of the tray-shaped elements.

In a $9^{th}$ according to any one of the preceding claims from the $2^{nd}$ to the $8^{th}$ the cutting tool is positioned for acting on said plastic precursor body and is configured for forming said through opening at a plurality of said cross regions.

In a $10^{th}$ aspect according to the preceding aspect wherein cutting tool is configured to shape said through opening in the form of a cutout portion removed from the plastic precursor body.

In an $11^{th}$ aspect according to one of the preceding two aspects the cutting tool is configured for forming each cutout portion by removing a part of a transverse band in correspondence of a median line between two longitudinally adjacent tray-shaped elements of a same row.

In a $12^{th}$ aspect according to any one of the preceding three aspects the cutting tool is configured and positioned such that each of said cutout portions is symmetrically located between two adjacent tray-shaped supports.

In a $13^{th}$ aspect according to any one of the preceding four aspects the cutting tool is configured and positioned such that each of said cutout portions is in the shape of one of:

- a triangular aperture delimited by three—straight or arc shaped—sides, and a quadrangular aperture delimited by four—straight or arc shaped—sides.

In a 14$^{th}$ aspect according to any one of the preceding five aspects the cutting tool is configured and positioned such that to form at the center of said cross regions a corresponding cutout portion in the shape of a quadrangular aperture delimited by four—straight or arc shaped—sides.

In a 15$^{th}$ aspect according to any one of the preceding aspects the packaging assembly includes:

a lower tool comprising a prefixed number of seats each designed for receiving at least one of said tray-shaped elements, and an upper tool facing the lower tool and configured for cooperating with the lower tool to fix said plastic film to at least one tray-shaped element positioned in said seat.

In a 16$^{th}$ aspect according to any one of the preceding aspects wherein the packaging assembly is also configured for tightly fixing the plastic film to close the top opening of said tray-shaped elements and includes:

lower tool comprising a prefixed number of seats each designed for receiving at least one of said tray-shaped elements, and upper tool facing the lower tool and configured for cooperating with the lower tool to fix said plastic film to at least one tray-shaped element positioned in said seat and sealingly close the respective top opening forming one or more closed tray-shaped elements.

In a 17$^{th}$ aspect according to any one of the preceding two aspects the apparatus comprises at least one main actuator active on at least one of said upper and lower tools.

In a 18$^{th}$ aspect according to the preceding aspect wherein a control unit is configured to operate the main actuator such that the upper and the lower tool are displaced between an open position, where the upper tool is spaced apart from the lower tool and forms a gap which allows positioning of the tray-shaped elements in the seats and of the plastic film above the tray-shaped elements, and a closure position, where the upper tool and the lower tool are in close proximity and act one against the other such as to sealingly fix the plastic film above the one or more tray-shaped elements located in the packaging assembly.

In a 19$^{th}$ aspect according to any one of the preceding four aspects the upper tool comprises means for holding a portion of the plastic film in correspondence of an active surface of the upper tool facing the lower tool.

In a 20$^{th}$ aspect according to the preceding aspect said means for holding comprises a vacuum source controlled by the/a control unit, the control unit being configured for activating the means for holding and causing the active surface to receive and hold said portion of the plastic film.

In a 21$^{st}$ aspect according to any one of the preceding six aspects the upper tool presents a flat active surface facing the lower tool and configured for receiving a portion of the plastic film that needs to be fixed onto the tray-shaped elements hosted in the lower tool.

In a 22$^{nd}$ aspect according to any one of the preceding aspects from the 15$^{th}$ to the 20$^{th}$ the upper tool presents a dome shaped active surface facing the lower tool and configured for receiving a portion of the plastic film that needs to be fixed onto the tray-shaped elements hosted in the lower tool.

In a 23$^{rd}$ aspect according to any one of the preceding two aspects wherein heating means is associated to the upper tool and controlled by the/a control unit, the control unit being configured for controlling the heating means such that the active surface of the upper tool is brought at least to a temperature comprised between 150° C. and 260° C., optionally between 180-240° C., more optionally between 200-220° C.

In a 24$^{th}$ aspect according to any one of the preceding aspects from the 15$^{th}$ to the 23$^{rd}$ the lower tool presents a number of base wall portions and a number of side wall portions emerging from respective of said base wall portions to define said number of seats and wherein one of said side wall portions carries at least a protrusion which is positioned and configured such that, when the tray-shaped elements are positioned in the respective seats of the lower tool, each protrusion is inserted into a respective through opening located in one of said cross regions and protrudes above the tray-shaped elements in direction of said dome shaped active surface.

In a 25$^{th}$ aspect according to any one of the preceding aspects 15$^{th}$ to the 24$^{th}$ the apparatus has a vacuum arrangement connected to the lower tool and configured for removing gas from an interior of said tray-shaped elements, the vacuum arrangement comprising at least one vacuum source and at least one evacuation line connecting said through opening to the vacuum source.

In a 26$^{th}$ aspect according to any one of the preceding aspects said, or a, control unit is configured to control the vacuum arrangement to withdraw gas at least when the upper and lower tools are in said closed position.

In a 27$^{th}$ aspect according to any one of the preceding aspects 15$^{th}$ to the 26$^{th}$ the apparatus has a controlled atmosphere arrangement connected to the lower tool and configured for injecting a gas stream into the interior of said tray-shaped elements, the controlled atmosphere arrangement comprising at least one injection device and at least one injection line connecting the through opening to the injection device.

In a 28$^{th}$ aspect according to any one of the preceding aspects said, or a, control unit, is configured to control said controlled atmosphere arrangement to inject said stream of gas at least when the upper and lower tools are in said closed position.

In a 29$^{th}$ aspect according to the preceding aspect, the controlled atmosphere arrangement is configured to inject gas or gas mixtures including a quantity of one or more of $N_2$, $O_2$ and $CO_2$ which is different from the quantity of these same gases as present in the atmosphere at 20° C. and sea level (1 atmosphere pressure).

In a 30$^{th}$ aspect according to the preceding aspect the apparatus includes both the vacuum arrangement and the controlled atmosphere arrangement and the control unit is configured to control said controlled atmosphere arrangement to start injecting said stream of gas either after a prefixed delay from activation of said vacuum arrangement or after a prefixed level of vacuum has been reached inside said interior of the tray-shaped elements.

In a 31$^{st}$ aspect according to the preceding aspect said control unit is configured to control said controlled atmosphere arrangement to start injecting said stream of gas while said gas withdrawal is still ongoing.

In a 32$^{nd}$ aspect according to any one of the preceding five aspects the control unit is configured to operate the vacuum arrangement for removing gas and create a vacuum level with pressure comprised between 0 and 300 m bar, preferably between 50 and 300 mbar, more preferably between 100 and 250 mbar, within said interior of the tray-shaped elements.

In a 33$^{rd}$ aspect according to any one of the preceding aspects each of said seats is delimited by a base wall portion and a side wall portion emerging from the respective base wall portion and wherein the at least one evacuation line and/or at least one injection line lead to:

a first groove defined in the side wall portion of each seat and opening to the inside of said seat, and/or a second grove defined in the base wall portion of each seat and opening to the inside of said seat.

In a 34$^{th}$ aspect according to any one of the preceding aspects the driving assembly includes a first active portion positioned downstream from the packaging assembly on both sides of the operating path and configured to grip longitudinal side borders of a longitudinal portion of the precursor body longitudinally extending downstream from the packaging assembly. In practice the precursor body is larger in width than the corresponding portion of the plastic film so that the first active portion engages the precursor body but not directly the longitudinal side borders of the plastic film which is pulled by the precursor body by virtue of the fact that downstream the packaging assembly the plastic film is fixed to the precursor body. The driving assembly is configured such that the longitudinal side borders of the precursor body and of the plastic film, in correspondence of the packaging assembly, are free and not engaged by any part of the driving assembly. This means that neither the first active portion nor any other driving means grip the longitudinal side borders of the precursor body and of the plastic film in correspondence of the packaging assembly.

In a 35$^{th}$ aspect according to the preceding aspect the driving assembly is configured such that the longitudinal side borders of the precursor body, in correspondence of the cutting tool, are free and not engaged by any part of the driving assembly. This means that neither the first active portion nor any other driving means grip the longitudinal side borders of the precursor body in correspondence of the zone where the cutting tool operates.

In a 36$^{th}$ aspect according to any one of the preceding aspects from the 1$^{st}$ to the 33$^{rd}$ the driving assembly includes a first active portion positioned downstream from the packaging assembly on both sides of the operating path and configured to grip longitudinal side borders of a longitudinal portion of the plastic film longitudinally extending downstream from the packaging assembly: in practice the plastic film is larger in width than the corresponding portion of the precursor body so that the first active portion engages the plastic film but not directly the longitudinal side borders of the precursor body. The driving assembly is also configured such that the longitudinal side borders of the precursor body and of the plastic film, in correspondence of the packaging assembly, are free and not engaged by any part of the driving assembly. This means that neither the first active portion nor any other driving means grip the longitudinal side borders of the precursor body and of the plastic film in correspondence of the packaging assembly.

In a 37$^{th}$ aspect according to the preceding aspect the driving assembly is configured such that the longitudinal side borders of the precursor body, in correspondence of the cutting tool, are free and not engaged by any part of the driving assembly. This means that neither the first active portion nor any other driving means grip the longitudinal side borders of the precursor body in correspondence of the zone where the cutting tool operates.

In a 38$^{th}$ aspect according to any one of the preceding aspects from the 1$^{st}$ to the 33$^{rd}$ the driving assembly includes a first active portion positioned downstream from the packaging assembly on both sides of the operating path and configured to grip longitudinal side borders of a longitudinal portion of the plastic film and of the precursor body longitudinally extending downstream from the packaging assembly. In this case the driving assembly is configured such that the longitudinal side borders of the precursor body and of the plastic film, in correspondence of the packaging assembly, are free and not engaged by any part of the driving assembly. This means that neither the first active portion nor any other driving means grip the longitudinal side borders of the precursor body and of the plastic film in correspondence of the packaging assembly.

In a 39$^{th}$ aspect according to the preceding aspect the driving assembly is configured such that the longitudinal side borders of the precursor body, in correspondence of the cutting tool are free and not engaged by any part of the driving assembly. This means that neither the first active portion nor any other driving means grip the longitudinal side borders of the precursor body in correspondence of the zone where the cutting tool operates.

In a 40$^{th}$ aspect according to any one of the preceding aspects from the 1$^{st}$ to the 33$^{rd}$ the driving assembly includes a first active portion positioned on both sides of the operating path and configured to grip:

longitudinal side borders of a longitudinal portion of the plastic film longitudinally extending downstream from the packaging assembly, and longitudinal side borders of a longitudinal portion of the plastic film longitudinally extending in correspondence of the packaging assembly.

In practice the plastic film is larger in width than the corresponding portion of the precursor body so that the first active portion engages the plastic film but not directly the longitudinal side borders of the precursor body.

Thus, the driving assembly is configured such that the longitudinal side borders of the precursor body, in correspondence of the packaging assembly, are free and not engaged by any part of the driving assembly. This means that in this case, neither the first active portion nor any other driving means grip the longitudinal side borders of the precursor body and that the first active portion only grips the plastic film.

In a 41$^{st}$ aspect according to the preceding aspect the driving assembly is configured such that the longitudinal side borders of the precursor body, in correspondence of the cutting tool are free and not engaged by any part of the driving assembly. This means that neither the first active portion nor any other driving means grip the longitudinal side borders of the precursor body in correspondence of the zone where the cutting tool operates.

In a 42$^{nd}$ aspect according to any one of the preceding two aspects the driving assembly is configured such that the first active portion also grips longitudinal side borders of a longitudinal portion of the plastic film extending between the film supply assembly and the packaging assembly; basically in this case the plastic film only is driven from the exit out of the supply assembly all the way through the packaging assembly and downstream the packaging assembly.

In a 43$^{rd}$ aspect according to any one of the preceding aspects the driving assembly includes a second active portion positioned between the forming station and the packaging assembly on both sides of the operating path and configured to grip longitudinal side borders of a portion of the precursor body longitudinally extending between the forming station and the packaging assembly.

In a 44$^{th}$ aspect according to the preceding aspect the driving assembly is configured such that the longitudinal side borders of the precursor body, in correspondence of the forming station are free and not engaged by any part of the driving assembly.

In a 45$^{th}$ aspect according to any one of the preceding aspects from the 1$^{st}$ to the 42$^{nd}$ the driving assembly includes a second active portion positioned between the supply assembly and the packaging assembly on both sides of the operating path and configured to grip the side borders of a portion of the precursor body longitudinally extending from the forming station, included, and the packaging assembly.

In a 46$^{th}$ aspect according to any one of preceding aspects from the 34$^{th}$ to the 45$^{th}$ the driving assembly includes:

at least one elongated driving body on each side of the operating path, wherein each elongated driving body is mounted to the support frame defining a closed path having a driving branch and a return branch;

a plurality of grippers carried by the elongated driving body and configured to grip opposite longitudinal side borders of the precursor body and/or of the plastic film; and at least a motor connected to the driving body and controlled by the/a control unit, this latter being configured to operate the motor such as to move the elongated driving body along said closed path, with the driving branch moving according to the machine direction and the return branch moving opposite to the machine direction.

In a 47$^{th}$ aspect according to the preceding aspect each elongated body is configured in said closed path such that the driving branch of the elongated body continuously comprises a first segment which extends according to one of the following configurations:

parallel to the operating path downstream from the packaging assembly;

parallel to the operating path at the packaging assembly and downstream from the packaging assembly;

transverse to the operating path, between the film supply assembly and the packaging assembly and, parallel to the operating path, at the packaging assembly and downstream from the packaging assembly, wherein the first active portion of the driving assembly comprises the gripping elements carried by said first segment.

In a 48$^{th}$ aspect according to the preceding aspect the gripping elements carried by said first segment are adapted to grip the side borders of the precursor body in apportion of this latter longitudinally downstream from the packaging assembly.

In a 49$^{th}$ aspect according to any one of the preceding two aspects the gripping elements carried by said first segment are adapted to grip the side borders of the plastic film either only downstream from the packaging assembly, or at the packaging assembly and downstream from the packaging assembly, or between the film supply assembly and the packaging assembly and at the packaging assembly and downstream from the packaging assembly.

In a 50$^{th}$ aspect according to any one of the preceding three aspects wherein the elongated body is configured in said closed path such that the driving branch of the elongated body continuously comprises a second segment which extends parallel to the operating path at least from downstream of the forming station up to upstream of the cutting tool wherein the gripping elements carried by said second segment are adapted to grip the longitudinal side borders of the precursor body longitudinally extending between the forming station and the packaging assembly;

wherein the second active portion of the driving assembly comprises the gripping elements carried by said second segment.

In a 51$^{st}$ aspect according to the preceding aspect the driving branch of the elongated body continuously comprises a third segment connecting a downstream end of the second segment to an upstream end of the first segment, the third segment extending along a trajectory which is sufficiently apart from the operating path in correspondence of the packaging assembly, and optionally of the cutting tool, whereby the gripping elements carried by said third segment do not engage the longitudinal side borders of neither the precursor body nor the plastic film at least in correspondence of the packaging assembly, and optionally in correspondence of the cutting tool.

In a 52$^{nd}$ aspect according to any one of the preceding five aspects the driving branch of the elongated body continuously comprises a fourth segment which extends parallel to the operating path at least from the supply assembly up to upstream of forming station wherein the gripping elements carried by said fourth segment are adapted to grip the longitudinal side borders of the precursor body longitudinally extending between the supply assembly and the forming station; wherein the second active portion of the driving assembly comprises the gripping elements carried by said fourth segment.

In a 53$^{rd}$ aspect according to the preceding aspects the driving assembly includes a fifth segment connecting a downstream end of the fourth segment to an upstream end of the second segment, the fifth segment extending along a trajectory which is sufficiently apart from the operating path in correspondence of the forming station whereby the gripping elements carried by said fifth segment do not engage the longitudinal side borders of the precursor body at least in correspondence of the forming station.

In a 54$^{th}$ aspect according to any one of the preceding aspects the cutting tool is positioned immediately upstream the packaging assembly.

In a 55$^{th}$ aspect according to any one of the preceding aspects including a control unit configured for execution of the following cycle:

commanding the forming station to form said tray-shaped elements into the precursor body coming from the supply assembly in the form of plastic web;

commanding the driving assembly to move in a step by step manner said precursor body such as to sequentially bring in the packaging assembly portions of the precursor body having a prefixed number of tray-shaped elements formed therein;

commanding the cutting tool to act on the precursor body in correspondence of a zone of the predefined path comprised between the web supply assembly and the packaging assembly and form said through opening;

commanding the packaging assembly to pass from the open to the closed position, optionally commanding the vacuum arrangement to remove gas and/or commanding the controlled atmosphere arrangement to inject a gas or a gas mixture, commanding the packaging assembly to tightly fix the plastic film to said tray-shaped elements in the packaging assembly commanding the separating assembly to transversely separate the closed tray-shaped elements and form a number of closed trays.

In a 56$^{th}$ aspect according to any one of the preceding aspects the film supply assembly id configured to supply a film comprising at least a first gas permeably layer and a second gas impermeable layer.

In a 57$^{th}$ aspect according to the preceding aspect the gas impermeable layer is removably attached to the underlying gas permeable layer. The gas impermeable layer may then be removed by a user after the packaging.

In a 58$^{th}$ aspect the gas permeable layer is a oxygen permeable layer, while the gas impermeable layer is a oxygen impermeable layer.

In a 59$^{th}$ aspect according to any one of the preceding aspects the apparatus comprise a second packaging assembly operating downstream packaging assembly (referred to in this case as first packaging assembly) and configured to apply a second plastic film.

In a 60$^{th}$ aspect the packaging assembly is configured for applying a first film to form a skin above the products P contained inside the tray-shaped elements and the second packaging assembly is configured to apply a second film on top of the tray shaped elements to create:

- a lid with normal atmosphere between the second film and the first film;
- a lid with modified atmosphere between the second film and the first film;
- a further skin formed by second film and first film.

In a 61$^{st}$ aspect according to the preceding aspect a second cutting tool is active on the tray-shaped elements which have received the film but which have not received the second plastic film in order to form further through opening of the type of analogous to the openings described in any one of aspects from the 1$^{st}$ to the 14$^{th}$. The second cutting tool would operate downstream the packaging assembly 20 but upstream, preferably immediately upstream, the second packaging assembly.

A 62$^{nd}$ aspect concerns a process of packaging products (P), said process optionally using an apparatus according to any one of the preceding aspects, the process comprising the following steps:

- supplying a plastic precursor body in the form of a plastic web;
- driving at least the precursor body in a machine direction along the operating path;
- receiving the precursor body in said form of plastic web and forming into it a number of cavities such that the precursor body comprises:
  - one or more longitudinal rows of adjacent tray-shaped elements,
  - longitudinal bands transversally delimiting each of said rows of tray-shaped elements,
  - transverse bands longitudinally delimiting and consecutively joining adjacent tray-shaped elements of a same longitudinal row, the transverse bands and the longitudinal bands delimiting top openings of the tray-shaped elements and crossing each other at a plurality of cross regions;
- loading one or more of said products (P) into a respective cavity of said tray-shaped elements;
- supplying a plastic film;
- fixing, preferably tightly fixing, the plastic film to close the top opening of said tray-shaped elements of the precursor body;
- transversely separating the closed tray-shaped elements thereby forming separated closed trays or groups of trays;
- before fixing the plastic film to the tray-shaped elements, forming a through opening located in correspondence of the precursor body.

In a 63$^{rd}$ aspect according to the preceding aspect forming a through opening located in correspondence of the precursor body comprises forming a through opening in correspondence of at least one of:

- a side wall of each of said tray-shaped elements, and
- a plurality of said cross regions of between the longitudinal and the transverse bands.

In a 64$^{th}$ aspect according to any one of the preceding two aspects comprising forming said plastic precursor body with two or more parallel rows of tray-shaped elements, wherein:

- each of said tray-shaped elements has a substantially rectangular top opening defined by two longitudinal side walls and two transverse side walls of the tray-shaped elements, and
- the transverse bands perpendicularly cross the longitudinal bands delimiting said rectangular top openings such that said cross regions are located in correspondence of corner zones of the tray-shaped elements.

In a 65$^{th}$ aspect according to the preceding aspect wherein forming a trough opening comprises forming said through opening at a plurality of said cross regions.

In a 66$^{th}$ aspect according to any one of preceding three aspects said through opening is shaped in the form of a cutout portion removed from the plastic precursor body, by removing a part of a transverse band in correspondence of a median line between two longitudinally adjacent tray-shaped elements of a same row.

In a 67$^{th}$ aspect according to the preceding aspect each of said cutout portions is symmetrically located between two adjacent tray-shaped supports.

In a 68$^{th}$ aspect according to any one of preceding two aspects each of said cutout portions is in the shape of one of a triangular aperture delimited by three—straight or arc shaped—sides, or a quadrangular aperture delimited by four—straight or arc shaped—sides.

In a 69$^{th}$ aspect according to any one of preceding aspects from the 62$^{nd}$ to the 68$^{th}$ comprising:

- holding a portion of the plastic film in correspondence and above of a corresponding tray-shaped element,
- heating the portion of plastic film at least to a temperature comprised between 150° C. and 260° C., optionally between 180-240° C., more optionally between 200-220° C.
- removing gas from an interior of said tray-shaped elements.

In a 70$^{th}$ aspect according to any one of preceding aspects from the 62$^{nd}$ to the 69$^{th}$ comprising:

- injecting a gas or a gas mixture into the interior of said tray-shaped elements to form controlled atmosphere inside said tray-shaped elements;

wherein the gas or gas mixtures includes a quantity of one or more of $N_2$, $O_2$ and $CO_2$ which is different from the quantity of these same gases as present in the atmosphere at 20° C. and sea level (1 atmosphere pressure).

In a 71$^{st}$ aspect according to any one of preceding aspects from the 62$^{nd}$ to the 70$^{th}$ comprising tightly fixing the plastic film to the respective tray shaped element.

In a 72$^{nd}$ aspect according to any one of preceding aspects from the 62$^{nd}$ to the 71$^{st}$ driving the precursor body comprises gripping longitudinal side borders the of precursor body in correspondence of a portion where the precursor body has fixedly received the plastic film, while leaving free the longitudinal side borders of the precursor body in correspondence of a portion of the precursor body where the fixing of the plastic film to the tray-shaped elements takes place.

In a 73rd aspect according to any one of preceding aspects from the 62nd to the 72nd driving the precursor body comprises gripping longitudinal side borders the of precursor body in correspondence of a portion where the precursor body has fixedly received the plastic film, while leaving free the longitudinal side borders of the precursor body in correspondence of a portion of the precursor body where the fixing of the plastic film to the tray-shaped elements takes place where the formation of the through openings, takes place.

In a 74th aspect according to any one of preceding aspects from the 62nd to the 71st the plastic film has a width measured perpendicular to the machine direction greater than the width of the underlying portion of precursor body. In this case driving the precursor body comprises gripping longitudinal side borders the of plastic film in correspondence of a portion where the precursor body has fixedly received the plastic film: the precursor body is not gripped and—above all the longitudinal side borders of the precursor body in correspondence of a portion of the precursor body where the fixing of the plastic film to the tray-shaped elements take place are left free from any gripping means other than being attached to the plastic film.

In a 75th aspect according to the preceding aspect the longitudinal side borders of the precursor body in correspondence of a portion of the precursor body where the formation of the through openings takes place are left free from any gripping means.

In a 76th aspect according to any one of preceding two aspects wherein driving the precursor body comprises gripping longitudinal side borders the of plastic film in correspondence of:

a portion of the plastic film longitudinally extending where the precursor body has fixedly received the plastic film, a portion of the plastic film longitudinally extending at the packaging assembly and optionally a portion of the plastic film longitudinally extending between the film supply and the plastic film fixing to the precursor body, while leaving free the longitudinal side borders of the precursor body in correspondence of a portion of the precursor body where the fixing of the plastic film to the tray-shaped elements, and optionally where the formation of the through openings, takes place.

In a 77th aspect according to any one of preceding aspects from the 62nd to the 71st driving the precursor body comprises gripping longitudinal side borders the of precursor body and of the plastic film in correspondence of a portion where the precursor body has fixedly received the plastic film, while leaving free the longitudinal side borders of the precursor body in correspondence of a portion of the precursor body where the fixing of the plastic film to the tray-shaped elements, and optionally where the formation of the through openings, takes place.

In a 78th aspect according to any one of preceding aspects from the 62nd to the 77th driving the precursor body comprises gripping longitudinal side borders the of precursor body in correspondence of a portion where the precursor body has not yet received the formation of the though openings, while leaving free the longitudinal side borders of the precursor body in correspondence of a portion of the precursor body where the formation of the through openings takes place.

In a 79th aspect according to any one of preceding aspects from the 62nd to the 78th driving the precursor body comprises gripping longitudinal side borders the of precursor body in correspondence of a portion where the precursor body is still in the form of a plastic web before formation of the cavities, while leaving free the longitudinal side borders of the precursor body in correspondence of a portion of the precursor body where the formation of the cavities takes place.

In an 80th aspect according to any one of preceding aspects from the 62nd to the 79th the through openings in the side wall of each of said tray-shaped elements are created—after formation of said number of cavities and definition of the adjacent tray shaped elements in the precursor body—by a cutting tool operating upstream a packaging station configured for tightly fixing the plastic film to the tray-shaped elements.

In an 81st aspect according to any one of preceding aspects from the 62nd to the 80th the through openings in the plurality of said cross regions between the longitudinal and the transverse bands are created—after formation of said number of cavities and definition of the adjacent tray shaped elements in the precursor body—by a cutting tool operating upstream a packaging station configured for tightly fixing the plastic film to the tray-shaped elements.

In an 82nd aspect the process uses the apparatus according to any one of the preceding aspects from the 1st to the 61st.

BRIEF DESCRIPTION OF THE DRAWINGS

The present invention will become clearer by reading the following detailed description, given by way of example and not of limitation, to be read with reference to the accompanying drawings, wherein:

FIG. 11 is a schematic representation of a variant of the packaging assembly of FIGS. 8-10.

FIG. 12 is perspective view of a tray which may be obtained using the apparatuses and processes herein described.

DEFINITIONS AND CONVENTIONS

Figure 1:
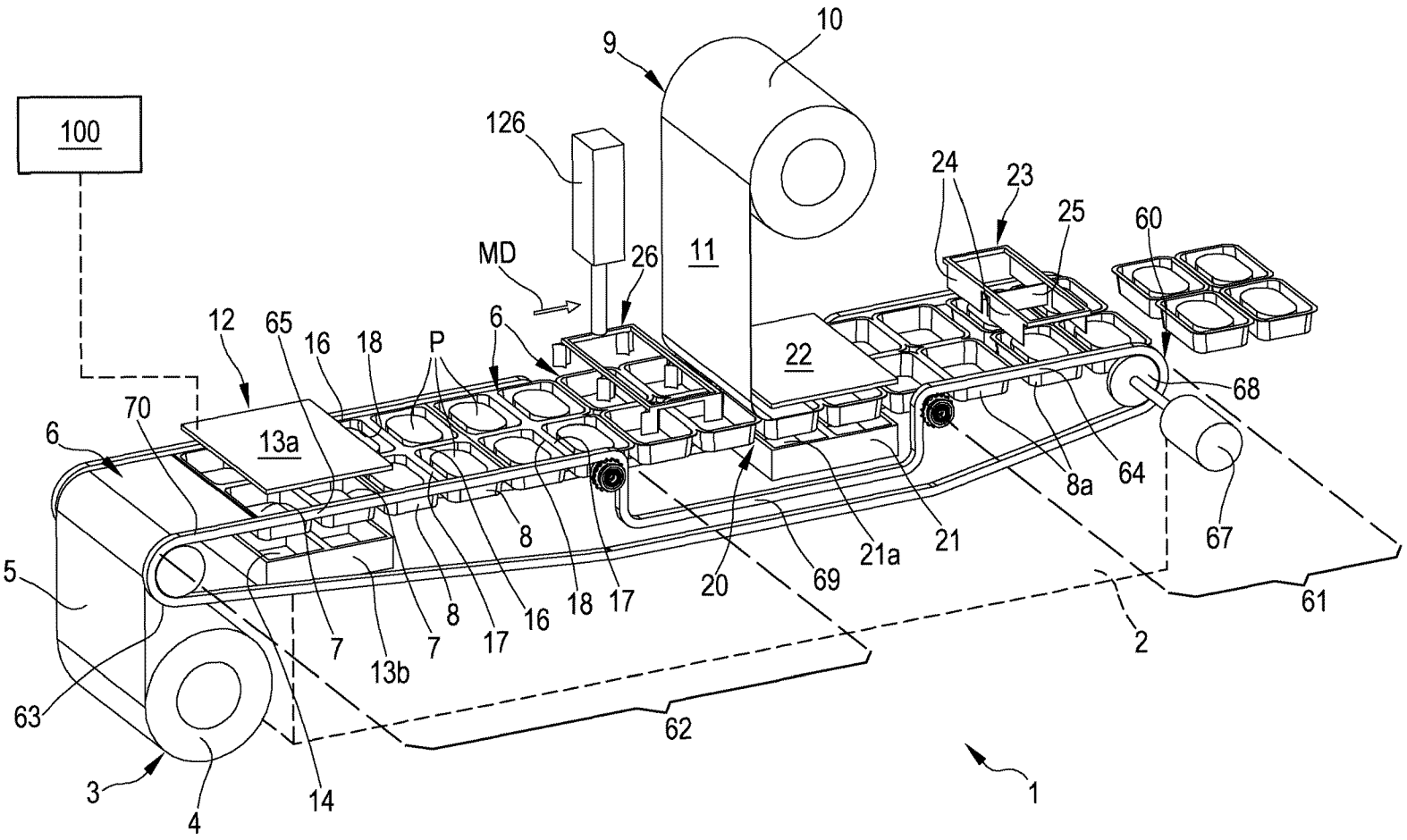
FIG. 1 is a schematic perspective view layout of a first apparatus according to aspects of the invention.

It should be noted that in the present detailed description corresponding parts shown in the various figures are indicated with the same reference numeral through the figures. Note that the figures are not in scale and thus the parts and components shown therein are schematic representations.

In the following description and claims the apparatus and process refer to packaging of a product inside a support or tray: the product may be a food product or not.

As used herein:

"tray" means a container of the type having a base wall, a side wall and optionally a top rim radially emerging from the side wall; the tray have a rectangular shape or any other suitable shape, such as round, square, elliptical etc.; when of rectangular or of square shape the corner regions of the tray may be rounded;

"operating path" is the path followed by the plastic precursor body during the packaging process;

"machine direction" is the direction of advancement of the precursor body along the operating path from the supply assembly to the separating assembly; the "machine direction" is identified as MD in the drawing tables and in the examples herein described is horizontal;

"downstream" and "upstream" refer to the relative position of components or assemblies or stations of the apparatus with reference to the machine direction;

"bands" refer to transverse or longitudinal bands of plastic material defined on the precursor body and crossing each other such as to delimit the top openings of the cavities of the tray-shaped elements formed in the precursor body; the bands have elongated conformation and, depending upon the shape of the cavities, may or may not present a substantially constant width (width of the longitudinal bands is measured perpendicular to the machine direction, while width of the transverse bands is measured parallel to the machine direction). For instance, in case the cavities have a perfectly rectangular top opening, then the longitudinal and transverse bands would be substantially straight stripes of constant width. In the case where the cavities have a substantially rectangular or substantially square shaped top openings with rounded corners (as in the examples of the attached drawings) then the bands present a width increase at cross regions where the transverse bands cross the longitudinal bands.

The Trays or Supports

The trays described and claimed herein may be made of a single layer or, preferably, of a multi-layer polymeric material formed in-line before loading the product or products in the tray cavity.

In case of a single layer material suitable polymers are for instance polystyrene, polypropylene, polyesters, high density polyethylene, poly(lactic acid), PVC and the like, either foamed or solid.

The tray material may be provided with gas barrier properties. As used herein such term refers to a film or sheet of material which has an oxygen transmission rate of less than 200 cm3/m2-day-bar, less than 150 cm3/m2-day-bar, less than 100 cm3/m2-day-bar as measured according to ASTM D-3985 at 23° C. and 0% relative humidity.

Suitable materials for gas barrier monolayer thermoplastic trays are for instance polyesters, polyamides and the like.

In case a multi-layer material is used for forming the tray, suitable polymers are for instance ethylene homo- and co-polymers, propylene homo- and co-polymers, polyamides, polystyrene, polyesters, poly(lactic acid), PVC and the like. Part of the multi-layer material can be solid and part can be foamed.

For example, the tray material may comprises at least one layer of a foamed polymeric material chosen from the group consisting of polystyrene, polypropylene, polyesters and the like.

The multi-layer material may be produced either by co-extrusion of all the layers using co-extrusion techniques or by glue- or heat-lamination of, for instance, a rigid foamed or solid substrate with a thin film, usually called "liner".

The thin film may be laminated either on the side of the tray in contact with the product P or on the side facing away from the product P or on both sides. In the latter case the films laminated on the two sides of the tray may be the same or different. A layer of an oxygen barrier material, for instance (ethylene-co-vinyl alcohol) copolymer, is optionally present to increase the shelf-life of the packaged product P.

Gas barrier polymers that may be employed for the gas barrier layer are PVDC, EVOH, polyamides, polyesters and blends thereof. The thickness of the gas barrier layer will be set in order to provide the tray with an oxygen transmission rate suitable for the specific packaged product.

The tray material may also comprise a heat sealable layer. Generally, the heat-sealable layer will be selected among the polyolefins, such as ethylene homo- or co-polymers, propylene homo- or co-polymers, ethylene/vinyl acetate copolymers, ionomers, and the homo- and co-polyesters, e.g. PETG, a glycol-modified polyethylene terephthalate.

Additional layers, such as adhesive layers, to better adhere the gas-barrier layer to the adjacent layers, may be present in the gas barrier material for the tray and are preferably present depending in particular on the specific resins used for the gas barrier layer.

In case of a multilayer material used to form the tray, part of this structure may be foamed and part may be un-foamed. For instance, the tray may comprise (from the outermost layer to the innermost food-contact layer) one or more structural layers, typically of a material such as foam polystyrene, foam polyester or foam polypropylene, or a cast sheet of e.g. polypropylene, polystyrene, poly(vinyl chloride), polyester or cardboard; a gas barrier layer and a heat-sealable layer.

The tray or trays described herein may be obtained from a sheet of foamed polymeric material having a film comprising at least one oxygen barrier layer and at least one surface sealing layer laminated onto the side facing the packaged product, so that the surface sealing layer of the film is the food contact layer the tray. A second film, either barrier or non-barrier, may be laminated on the outer surface of the tray.

Specific tray material formulations are used for food products which require heating in conventional or microwave oven before consumption. The surface of the container in contact with the product, i.e. the surface involved in the formation of the seal with the lidding film, comprises a polyester resin. For instance the container can be made of a cardboard coated with a polyester or it can be integrally made of a polyester resin. Examples of suitable containers for the package of the invention are CPET, APET or APET/CPET containers. Such container can be either foamed or not-foamed.

Trays materials used for lidding or skin applications containing foamed parts, have a total thickness lower than 8 mm, and for instance may be comprised between 0.5 mm and 7.0 mm and more frequently between 1.0 mm and 6.0 mm.

In case of rigid tray not containing foamed parts, the total thickness of the single-layer or multi-layer thermoplastic material is preferably lower than 2 mm, and for instance may be comprised between 0.1 mm and 1.2 mm and more frequently between 0.2 mm and 1.0 mm.

The Plastic Film

The plastic film described and claimed herein may be applied to form a lid onto the tray (e.g. for MAP—modified atmosphere packaging) or a skin associated to the tray and matching the contour of the product.

The film for skin applications may be made of a flexible multi-layer material comprising at least a first outer heat-sealable layer, an optional gas barrier layer and a second outer heat-resistant layer. The outer heat-sealable layer may comprise a polymer capable of welding to the inner surface of the supports carrying the products to be packaged, such as for instance ethylene homo- or co-polymers, like LDPE, ethylene/alpha-olefin copolymers, ethylene/acrylic acid copolymers, ethylene/methacrylic acid copolymers, and ethylene/vinyl acetate copolymers, ionomers, co-polyesters, e.g. PETG. The optional gas barrier layer preferably comprises oxygen impermeable resins like PVDC, EVOH, polyamides and blends of EVOH and polyamides. The outer heat-resistant layer may be made of ethylene homo- or copolymers, ethylene/cyclic-olefin copolymers, such as ethylene/norbornene copolymers, propylene homo- or co-polymers, ionomers, (co)polyesters, (co)polyamides. The film may also comprise other layers such as adhesive layers or bulk layers to increase thickness of the film and improve its abuse and deep drawn properties. Particularly used bulk layers are ionomers, ethylene/vinyl acetate copolymers, polyamides and polyesters. In all the film layers, the polymer components may contain appropriate amounts of additives normally included in such compositions. Some of these additives are preferably included in the outer layers or in one of the outer layers, while some others are preferably added to inner layers. These additives include slip and anti-block agents such as talc, waxes, silica, and the like, antioxidants, stabilizers, plasticizers, fillers, pigments and dyes, cross-linking inhibitors, cross-linking enhancers, UV absorbers, odour absorbers, oxygen scavengers, bactericides, antistatic agents and the like additives known to those skilled in the art of packaging films.

One or more layers of the film can be cross-linked to improve the strength of the film and/or its heat resistance. Cross-linking may be achieved by using chemical additives or by subjecting the film layers to an energetic radiation treatment. The films for skin packaging are typically manufactured in order to show low shrink when heated during the packaging cycle. Those films usually shrink less than 15% at 160° C., more frequently lower than 10%, even more frequently lower than 8% in both the longitudinal and transversal direction (ASTM D2732). The films usually have a thickness comprised between 20 microns and 200 microns, more frequently between 40 and 180 microns and even more frequently between 50 microns and 150 microns.

The skin packages are usually "easy-to-open", i.e. they are easily openable by manually pulling apart the two webs, normally starting from a point like a corner of the package where the upper web has purposely not been sealed to the support. To achieve this feature, either the film or the tray can be provided with a suitable composition, allowing easy opening of the package, as known in the art. Typically, the sealant composition and/or the composition of the adjacent layer of the tray and/or the film are adjusted in order to achieve the easy opening feature.

Various mechanisms can occur while opening an easy-to-open package.

In the first one ("peelable easy opening"), the package is opened by separating the film and the tray at the seal interface.

In the second mechanism ("adhesive failure") the opening of the package is achieved through an initial breakage through the thickness of one of the sealing layers followed by delamination of this layer from the underlying support or film.

The third system is based on the "cohesive failure" mechanism: the easy opening feature is achieved by internal rupture of a seal layer that, during opening of the package, breaks along a plane parallel to the layer itself.

Specific blends are known in the art to obtain such opening mechanisms, ensure the peeling of the film from the tray surface, such as those described in EP1084186.

On the other hand, in case the film is used for creating a lid on the tray, the film material may be obtained by co-extrusion or lamination processes. Lid films may have a symmetrical or asymmetrical structure and can be monolayer or multilayer.

The multilayer films have at least 2, more frequently at least 5, even more frequently at least 7 layers.

The total thickness of the film may vary frequently from 3 to 100 micron, in particular from 5 to 50 micron, even more frequently from 10 to 30 micron.

The films may be optionally cross-linked. Cross-linking may be carried out by irradiation with high energy electrons at a suitable dosage level as known in the art. The lid films described above may be heat shrinkable or heat-set. The heat shrinkable films typically show free shrink value at 120° C. measured according to ASTM D2732 in the range of from 2 to 80%, more frequently from 5 to 60%, even more frequently from 10 to 40% in both the longitudinal and transverse direction. The heat-set films usually have free shrink values lower than 10% at 120° C., preferably lower than 5% in both the longitudinal and transversal direction (ASTM D 2732). Lid films usually comprise at least a heat sealable layer and an outer skin layer, which is generally made up of heat resistant polymers or polyolefin. The sealing layer typically comprises a heat-sealable polyolefin which in turn comprises a single polyolefin or a blend of two or more polyolefins such as polyethylene or polypropylene or a blend thereof. The sealing layer can be further provided with antifog properties by incorporating one or more antifog additives into its composition or by coating or spraying one or more antifog additives onto the surface of the sealing layer by technical means well known in the art. The sealing layer may further comprise one or more plasticisers. The skin layer may comprises polyesters, polyamides or polyolefins. In some structures, a blend of polyamide and polyester can advantageously be used for the skin layer. In some cases, the lid films comprise a barrier layer. Barrier films typically have an OTR (evaluated at 23° C. and 0% R.H. according to ASTM D-3985) below 100 $cm^3/(m^2 \cdot day \cdot atm)$ and more frequently below 80 $cm^3/(m^2 \cdot day \cdot atm)$. The barrier layer is usually made of a thermoplastic resin selected among a saponified or hydrolyzed product of ethylene-vinyl acetate copolymer (EVOH), an amorphous polyamide and a vinyl-vinylidene chloride and their admixtures. Some materials comprise an EVOH barrier layer, sandwiched between two polyamide layers. The skin layer typically comprises polyesters, polyamides or polyolefin.

In some packaging applications, the lid films do not comprise any barrier layer. Such films usually comprise one or more polyolefin are herein defined.

Non-barrier films typically have an OTR (evaluated at 23° C. and 0% R.H. according to ASTM D-3985) from 100 $cm^3/(m^2 \cdot day \cdot atm)$ up to 10000 $cm^3/(m^2$ day atm), more typically up to 6000 $cm^3/(m^2$ day atm).

Peculiar compositions polyester-based are those used for tray lidding of ready-meals packages. For these films, the polyester resins can make up at least 50%, 60%, 70%, 80%, 90% by weight of the film. These films are typically used in combination with polyester-based supports.

For instance the container can be made of a cardboard coated with a polyester or it can be integrally made of a polyester resin. Examples of suitable containers for the package are CPET, APET or APET/CPET containers, either foamed or not-foamed.

Usually, biaxially oriented PET are used as the lid film due to its high thermal stability at standard food heating/cooking temperatures. Often biaxially oriented polyester films are heat-set, i.e. non-heat-shrinkable. To improve the heat-sealability of the PET lidding film to the container a heat-sealable layer of a lower melting material is usually provided on the film. The heat-sealable layer may be coextruded with the PET base layer (as disclosed in EP-A-1,529,797 and WO2007/093495) or it may be solvent- or extrusion-coated over the base film (as disclosed in U.S. Pat. No. 2,762,720 and EP-A-1,252,008).

Particularly in the case of fresh red meat packages, twin lidding film comprising an inner, oxygen-permeable, and an outer, oxygen-impermeable, lidding film are advantageously used. The combination of these two films significantly prevents the meat discoloration also when the packaged meat extends upwardly with respect to the height of the tray walls, which is the most critical situation in barrier packaging of fresh meat.

These films are described for example in EP1848635 and EP0690012, the disclosures of which are herein incorporated by reference.

The lid film can be monolayer. Typical composition of monolayer films comprise polyesters as herein defined and their blends or polyolefins as herein defined and their blends.

In all the film layers herein described, the polymer components may contain appropriate amounts of additives normally included in such compositions. Some of these additives are preferably included in the outer layers or in one of the outer layers, while some others are preferably added to inner layers. These additives include slip and anti-block agents such as talc, waxes, silica, and the like, antioxidants, stabilizers, plasticizers, fillers, pigments and dyes, cross-linking inhibitors, cross-linking enhancers, UV absorbers, odor absorbers, oxygen scavengers, bactericides, antistatic agents, anti-fog agents or compositions, and the like additives known to those skilled in the art of packaging films.

The films suitable for lidding application can advantageously be perforated, in order to allow the packaged food to breath. Those films may be perforated by using different technologies available in the art, through laser or mechanical means such as rolls provided with several needles. The number of perforations per unit area of the film and their dimensions affect the gas permeability of the film. Microperforated films are usually characterized by OTR value (evaluated at 23° C. and 0% R.H. according to ASTM D-3985) from 2500 $cm^3/(m^2 \cdot day \cdot atm)$ up to 1000000 $cm^3/(m^2 \cdot day \cdot atm)$. Macroperforated films are usually characterized by OTR (evaluated at 23° C. and 0% R.H. according to ASTM D-3985) higher than 1000000 $cm^3/(m^2 \cdot day \cdot atm)$.

Furthermore, the films herein described for lidding applications can be formulated to provide strong or peelable sealing onto the support. A method of measuring the force of a peelable seal, herein referred to as "peel force" is described in ASTM F-88-00. Acceptable peel force values fare in the range from 100 g/25 mm to 850 g/25 mm, from 150 g/25 mm to 800 g/25 mm, from 200 g/25 mm to 700 g/25 mm.

The desired seal strength is achieved specifically designing the tray and the lid formulations.

In general, one or more layers of the lid film can be printed, in order to provide useful information to the consumer, a pleasing image and/or trademark or other advertising information to enhance the retail sale of the packaged product. The film may be printed by any suitable method, such as rotary screen, gravure or flexographic techniques mas known in the art.

Definitions and Conventions Concerning Materials

PVDC is any vinylidene chloride copolymers wherein a major amount of the copolymer comprises vinylidene chloride and a minor amount of the copolymer comprises one or more unsaturated monomers copolymerisable therewith, typically vinyl chloride, and alkyl acrylates or methacrylates (e.g. methyl acrylate or methacrylate) and the blends thereof in different proportions. Generally a PVDC barrier layer will contain plasticisers and/or stabilizers as known in the art.

As used herein, the term EVOH includes saponified or hydrolyzed ethylene-vinyl acetate copolymers, and refers to ethylene/vinyl alcohol copolymers having an ethylene comonomer content preferably comprised from about 28 to about 48 mole %, more preferably, from about 32 to about 44 mole % ethylene, and even more preferably, and a saponification degree of at least 85%, preferably at least 90%.

The term "polyamides" as used herein is intended to refer to both homo- and co- or ter-polyamides. This term specifically includes aliphatic polyamides or co-polyamides, e.g., polyamide 6, polyamide 11, polyamide 12, polyamide 66, polyamide 69, polyamide 610, polyamide 612, copolyamide 6/9, copolyamide 6/10, copolyamide 6/12, copolyamide 6/66, copolyamide 6/69, aromatic and partially aromatic polyamides or co-polyamides, such as polyamide 61, polyamide 6I/6T, polyamide MXD6, polyamide MXD6/MXDI, and blends thereof.

As used herein, the term "copolymer" refers to a polymer derived from two or more types of monomers, and includes terpolymers. Ethylene homopolymers include high density polyethylene (HDPE) and low density polyethylene (LDPE). Ethylene copolymers include ethylene/alpha-olefin copolymers and ethylene/unsaturated ester copolymers. Ethylene/alpha-olefin copolymers generally include copolymers of ethylene and one or more comonomers selected from alpha-olefins having from 3 to 20 carbon atoms, such as 1-butene, 1-pentene, 1-hexene, 1-octene, 4-methyl-1-pentene and the like.

Ethylene/alpha-olefin copolymers generally have a density in the range of from about 0.86 to about 0.94 g/cm3. The term linear low density polyethylene (LLDPE) is generally understood to include that group of ethylene/alpha-olefin copolymers which fall into the density range of about 0.915 to about 0.94 g/cm3 and particularly about 0.915 to about 0.925 g/cm3. Sometimes linear polyethylene in the density range from about 0.926 to about 0.94 g/cm3 is referred to as linear medium density polyethylene (LMDPE). Lower density ethylene/alpha-olefin copolymers may be referred to as very low density polyethylene (VLDPE) and ultra-low density polyethylene (ULDPE). Ethylene/alpha-olefin copolymers may be obtained by either heterogeneous or homogeneous polymerization processes.

Another useful ethylene copolymer is an ethylene/unsaturated ester copolymer, which is the copolymer of ethylene and one or more unsaturated ester monomers. Useful unsaturated esters include vinyl esters of aliphatic carboxylic acids, where the esters have from 4 to 12 carbon atoms, such as vinyl acetate, and alkyl esters of acrylic or methacrylic acid, where the esters have from 4 to 12 carbon atoms.

Ionomers are copolymers of an ethylene and an unsaturated monocarboxylic acid having the carboxylic acid neutralized by a metal ion, such as zinc or, preferably, sodium.

Useful propylene copolymers include propylene/ethylene copolymers, which are copolymers of propylene and ethylene having a majority weight percent content of propylene, and propylene/ethylene/butene terpolymers, which are copolymers of propylene, ethylene and 1-butene.

As used herein, the term "polyolefin" refers to any polymerized olefin, which can be linear, branched, cyclic, aliphatic, aromatic, substituted, or unsubstituted. More specifically, included in the term polyolefin are homo-polymers of olefin, co-polymers of olefin, co-polymers of an olefin and an non-olefinic co-monomer co-polymerizable with the olefin, such as vinyl monomers, modified polymers thereof, and the like. Specific examples include polyethylene homopolymer, polypropylene homo-polymer, polybutene homopolymer, ethylene-alpha-olefin co-polymer, propylene-alpha-olefin co-polymer, butene-alpha-olefin co-polymer, ethylene-unsaturated ester co-polymer, ethylene-unsaturated acid co-polymer, (e.g. ethylene-ethyl acrylate co-polymer, ethylene-butyl acrylate co-polymer, ethylene-methyl acrylate co-polymer, ethylene-acrylic acid co-polymer, and ethylene-methacrylic acid co-polymer), ethylene-vinyl acetate copolymer, ionomer resin, polymethylpentene, etc.

The term "polyester" is used herein to refer to both homo- and co-polyesters, wherein homo-polyesters are defined as polymers obtained from the condensation of one dicarboxylic acid with one diol and co-polyesters are defined as polymers obtained from the condensation of one or more dicarboxylic acids with one or more diols. Suitable polyester resins are, for instance, polyesters of ethylene glycol and terephthalic acid, i.e. poly(ethylene terephthalate) (PET). Preference is given to polyesters which contain ethylene units and include, based on the dicarboxylate units, at least 90 mol %, more preferably at least 95 mol %, of terephthalate units. The remaining monomer units are selected from other dicarboxylic acids or diols. Suitable other aromatic dicarboxylic acids are preferably isophthalic acid, phthalic acid, 2,5-, 2,6- or 2,7-naphthalenedicarboxylic acid. Of the cycloaliphatic dicarboxylic acids, mention should be made of cyclohexanedicarboxylic acids (in particular cyclohexane-1,4-dicarboxylic acid). Of the aliphatic dicarboxylic acids, the (C3-Ci9)alkanedioic acids are particularly suitable, in particular succinic acid, sebacic acid, adipic acid, azelaic acid, suberic acid or pimelic acid. Suitable diols are, for example aliphatic diols such as ethylene glycol, diethylene glycol, triethylene glycol, propylene glycol, 1,3-butane diol, 1,4-butane diol, 1,5-pentane diol, 2,2-dimethyl-1,3-propane diol, neopentyl glycol and 1,6-hexane diol, and cycloaliphatic diols such as 1,4-cyclohexanedimethanol and 1,4-cyclohexane diol, optionally heteroatom-containing diols having one or more rings.

Co-polyester resins derived from one or more dicarboxylic acid(s) or their lower alkyl (up to 14 carbon atoms) diesters with one or more glycol(s), particularly an aliphatic or cycloaliphatic glycol may also be used as the polyester resins for the base film. Suitable dicarboxylic acids include aromatic dicarboxylic acids such as terephthalic acid, isophthalic acid, phthalic acid, or 2,5-, 2,6- or 2,7-naphthalenedicarboxylic acid, and aliphatic dicarboxylic acids such as succinic acid, sebacic acid, adipic acid, azelaic acid, suberic acid or pimelic acid. Suitable glycol(s) include aliphatic diols such as ethylene glycol, diethylene glycol, triethylene glycol, propylene glycol, 1,3-butane diol, 1,4-butane diol, 1,5-pentane diol, 2,2-dimethyl-1,3-propane diol, neopentyl glycol and 1,6-hexane diol, and cycloaliphatic diols such as 1,4-cyclohexanedimethanol and 1,4-cyclohexane diol. Examples of such copolyesters are (i) copolyesters of azelaic acid and terephthalic acid with an aliphatic glycol, preferably ethylene glycol; (ii) copolyesters of adipic acid and terephthalic acid with an aliphatic glycol, preferably ethylene glycol; and (iii) copolyesters of sebacic acid and terephthalic acid with an aliphatic glycol, preferably butylene glycol; (iv) co-polyesters of ethylene glycol, terephthalic acid and isophthalic acid. Suitable amorphous co-polyesters are those derived from an aliphatic diol and a cycloaliphatic diol with one or more, dicarboxylic acid(s), preferably an aromatic dicarboxylic acid. Typical amorphous copolyesters include co-polyesters of terephthalic acid with an aliphatic diol and a cycloaliphatic diol, especially ethylene glycol and 1,4-cyclohexanedimethanol.

DETAILED DESCRIPTION

Apparatus 1

Figure 2:
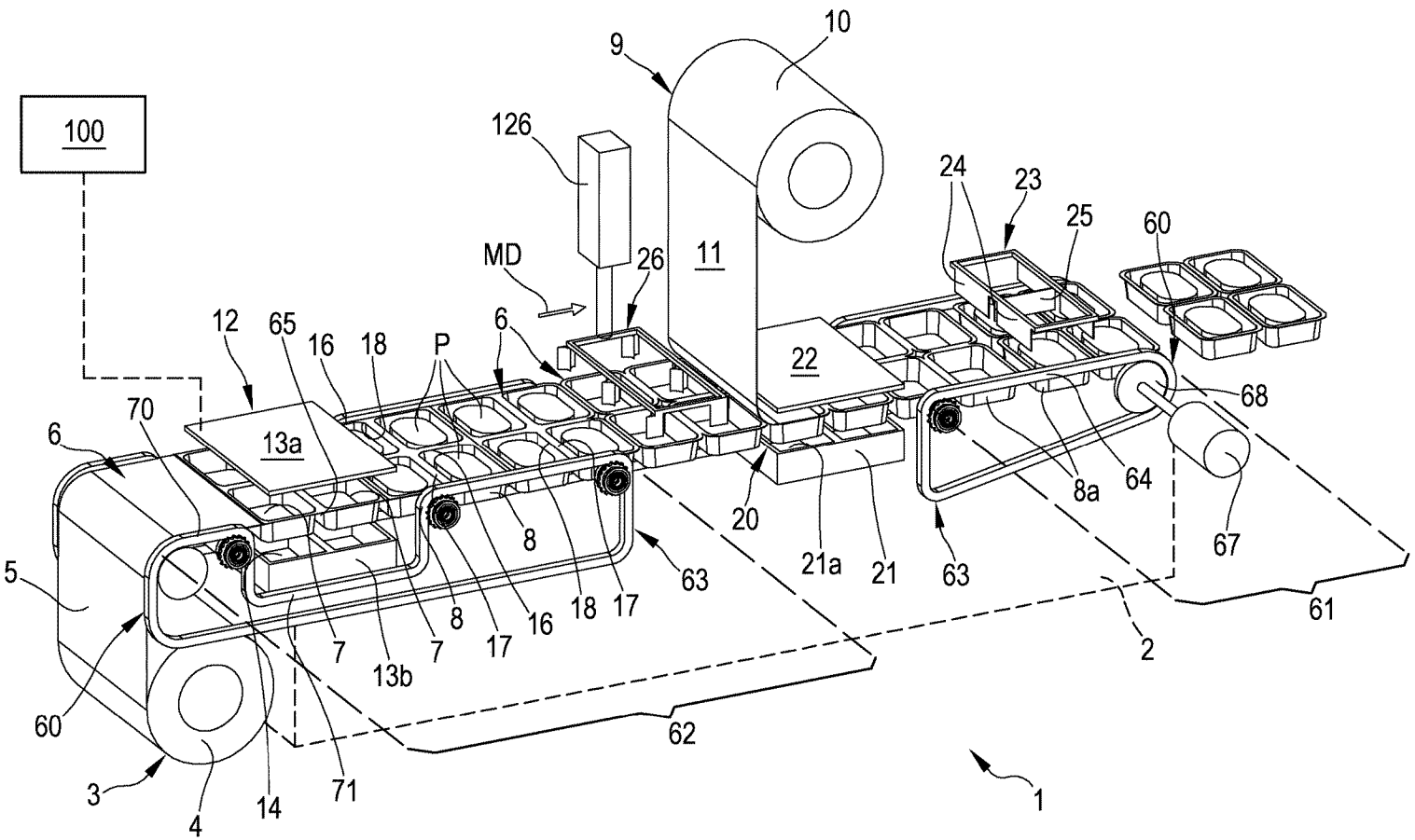
FIG. 2 is a schematic perspective view layout of a second apparatus according to aspects of the invention.

FIG. 1-3 show variants of an apparatus 1 for packaging of a product P. The apparatus 1 is adapted for modified atmosphere packaging, where a plastic film is applied to the top rim of a support or tray after a modified gas atmosphere has been created inside the tray, and/or for vacuum skin packaging of the product P, where a thin film of plastic material is draped down on the product and intimately adheres to a top rim and to the inner surface of the support as well as to the product surface thus leaving a minimum, if any, amount of air within the packaging. The apparatus 1 may also be used in case a plastic film is applied to the tray and neither vacuum nor modified atmosphere is created.

The apparatus 1 comprises a support frame 2 (schematically represented in phantom lines) which defines, e.g. on a top portion thereof, an operating path which in the example shown is horizontal. A web supply assembly 3, preferably carried by the support frame 2, comprises a roller 4 of plastic web 5 which is then used to in-line form the trays; in practice the plastic web 5 is unwound from the roller 4 and defines a plastic precursor body 6 in which the cavities 7 of tray-shaped elements 8 are then formed in-line as it is further described herein below. A film supply assembly 9, preferably carried by said supporting frame 2, comprises a respective roller 10 configured to supply a plastic film 11 to be fixed on top of the tray-shaped elements 8. The plastic film may include at least one gas permeable layer and at least a gas (in particular oxygen) impermeable layer.

A forming station 12 is mounted on the support frame 2 and positioned on the operating path. The forming station 12 is configured to receive from roller 4 the precursor body 6 when this latter is still in the form of a plastic web and create into it the cavities 7. In practice, the forming station 12 comprises at least an upper portion 13*a* and at least a lower portion 13*b* which are movable the one with respect to the other such that, in an open condition where the two portions 13*a*, 13*b* are spaced apart from each other, a longitudinal section of the web shaped precursor body 6 may be positioned in correspondence of the forming station, and, in a closed position where the two portions 13*a*, 13*b* are moved one against the other, the two portions define one or more molding cavities 14 wherein the tray-shaped elements are formed into the precursor body. In this respect, at least one of the upper and lower portions 13*a*, 13*b* presents one or more molding portions defining said molding cavities shaped as the tray-shaped elements to be formed; the forming station may include molding portions (e.g. male and female elements) which—when the forming station is in the closed position—mechanically force the web material of precursor body to take the desired shape; alternatively the forming station may include one or more gas injection devices for blow molding the web material against the molding cavities 14 and form the tray-shaped elements; in a further alternative the forming station may include one or more gas withdrawal devices for sucking the web material into the molding cavities. Of course other molding techniques may be adopted for forming the web material. In order to facilitate the shaping of the web material the upper and/or the lower portion of the precursor body may be heated at an appropriate temperature.

In any case the forming station 12 is configured such that, when exiting from the forming station, the precursor body 6 comprises one or more longitudinal rows 15 of adjacent tray-shaped elements 8 (in the example shown in FIGS. 1-4 two horizontal rows 15 of tray-shaped elements 8 are progressively formed by the forming station 12), each of the rows 15 of tray-shaped elements is transversally delimited by longitudinal bands 16, while transverse bands 17 longitudinally delimit and consecutively join adjacent tray-shaped elements of the same longitudinal row.

As it is visible in FIGS. 1-4, the transverse bands and the longitudinal bands delimit top openings 18 of the tray-shaped elements 8 and cross each other at a plurality of cross regions 19: in the examples shown the top openings are substantially rectangular and are defined by two longitudinal side walls and two transverse side walls of the tray-shaped elements; consequently the transverse bands perpendicularly cross the longitudinal bands delimiting said rectangular top openings 18 such that said cross regions are located in correspondence of corner zones of the tray-shaped elements. In the examples shown the top openings are formed to have rounded corners, thus the transverse and longitudinal bands 16, 17 present a substantially straight conformation with enlargements at the cross regions 19.

A packaging assembly 20, also positioned on the frame 2 along said operating path, is configured to receive said plastic film 11 and said precursor body 6. The packaging assembly 20 is configured for tightly fixing the plastic film 11 to close the top openings 18 of the tray-shaped elements 8 and comprises at least a lower tool 21 defining a prefixed number of seats 21*a* (in the example shown four seats 21*a*, two per row). Each seat 21*a* is designed for receiving one respective of said tray-shaped elements 8. An upper tool 22, also part of the packaging assembly, faces the lower tool 21 and is configured for cooperating with the lower tool to fix said plastic film 11 to the tray-shaped elements 8 positioned in said seats 21*a* and sealingly close the respective top openings 18 forming one or more closed tray-shaped elements 8*a* hosting one or more product P which is for instance loaded—either automatically or manually—into the cavities of the tray-shaped elements downstream the forming station 12 (note that in FIGS. 1-4 the product P inside the tray-shaped elements has been sometimes omitted for sake of clarity of the drawing).

Downstream the packaging assembly operates a separating assembly 23 positioned along said path and configured for at least transversely separating the closed tray-shaped elements and form closed trays 8*b*. The separating assembly 23 may include a transverse blade 24 positioned on the frame 2 perpendicularly to the machine direction MD and configured for separating longitudinally adjacent closed tray-shaped elements 8*a* by cutting the transverse bands 17 in correspondence of a median line 17*a* thereof; the separating assembly 23 may also include a longitudinal blade 25 positioned on the frame 2 parallel to the machine direction MD and configured for separating transversally adjacent rows of tray-shaped elements by cutting a number of longitudinal bands 16 in correspondence of a median line 16*a* thereof (median lines 16*a* and 17*a* are visible in FIG. 4).

Figure 5:
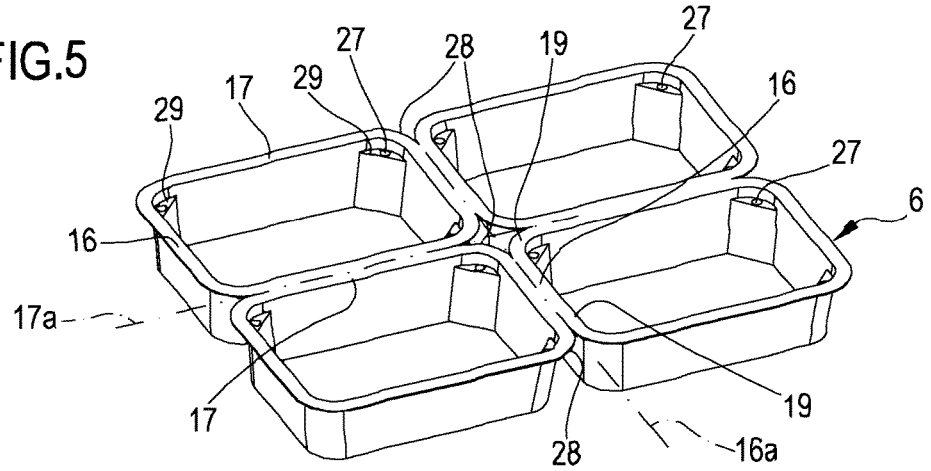
FIGS. 5-7 are perspective views showing a portion of a precursor body with tray-shaped elements provided with through openings according to aspects of the invention.
Figure 6:
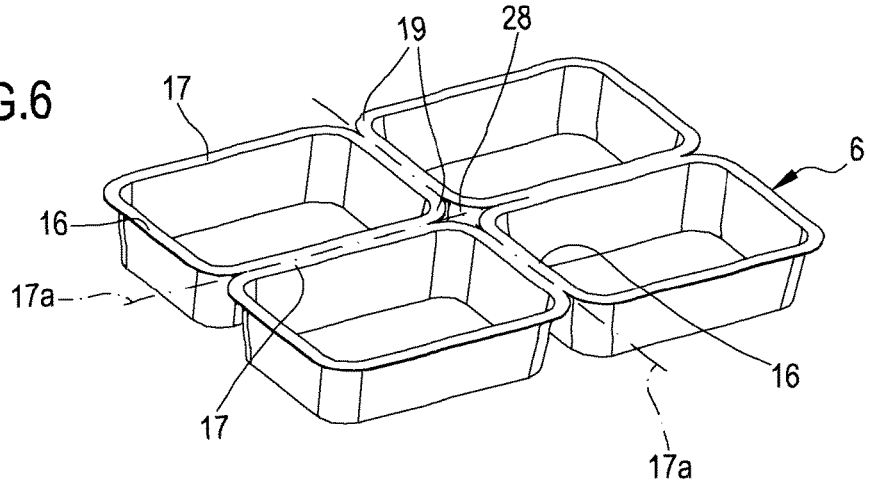
Figure 7:
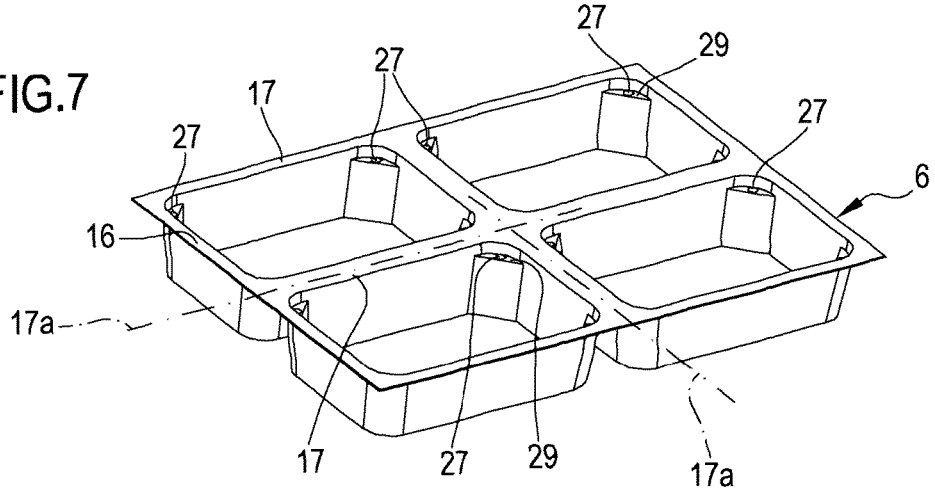
Figure 8:
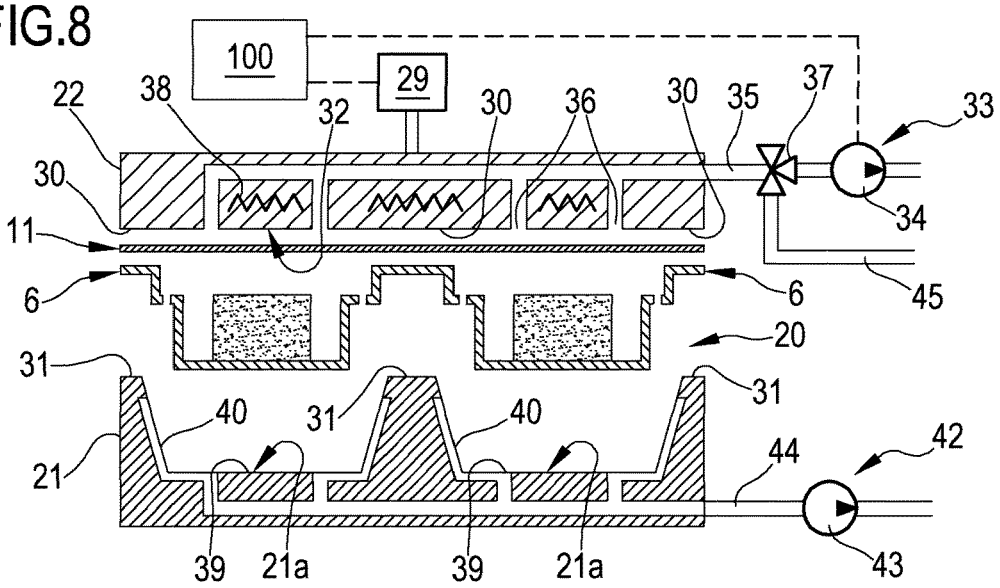
FIGS. 8-10 schematically shows a packaging assembly, which may be used in the apparatus shown in any one of figures from 1 to 3; the figures relate to sequential steps followed by the packaging assembly according to aspects of the invention.

According to an aspect of the invention, a cutting tool 26 may be carried by the support frame 2 and may be configured to be active to form cuts on the precursor body 6 in correspondence of a zone of the predefined path comprised between the web supply assembly 3 and the packaging assembly 20; a tool actuator 126 (e.g.: of the hydraulic, pneumatic, or electric type) may act on the cutting tool 26: tool actuator is controlled by control unit 100 such as to lower and raise the cutting tool and obtain formation of trough openings 27 and 28; in accordance with a further aspect the cutting tool 26 may operate immediately upstream of the packaging assembly 20 such that—as the precursor body has been processed by the cutting tool 26 and moves in the machine direction MD—it immediately enters into the packaging assembly. The cutting tool 26 is configured for forming in the precursor body a through opening 27 located in correspondence of a side wall of each of said tray-shaped elements (see FIGS. 5 and 7) or a through opening 28 located in correspondence of a plurality of said cross regions 19 between the longitudinal and the transverse bands (see FIGS. 5 and 6). In an example, a through opening 27 may be formed through horizontal ledges 29 formed in the corner regions of each of the tray-shaped elements 8 (FIG. 7); in another example a through opening 28 may be formed at each of the cross regions 19 between said longitudinal and said transverse bands (FIG. 6); in yet another example a through opening 27 may be formed on horizontal ledges 29 defined in the corner regions of the tray-shaped elements and a through opening 28 may be formed at the cross regions 19 between said longitudinal and said transverse bands (FIGS. 5 and 6).

The cutting tool 26 may be configured to shape the through openings 28 at the corner regions 19 in the form of a cutout portion removed from the plastic precursor body: in particular the cutting tool 26 may be configured for forming each cutout portion by removing a part of said corner regions 19 in correspondence of the median line between two longitudinally adjacent tray-shaped elements of a same row; in practice the cut out portions create passages for gas communication to the inside of each adjacent tray-shaped portions during application of the plastic film; moreover, due to the shape and position of the cutout portions defining the through openings 28, the continuity of the horizontal rim of each tray under formation is not compromised and thus formation of large horizontal tray rims not required.

In accordance with a specific aspect the cutting tool 26 is configured and positioned such that each of said cutout portions is symmetrically located between two adjacent tray-shaped supports, and forms a triangular aperture delimited by three—straight or arc shaped—sides, or a quadrangular aperture delimited by four—straight or arc shaped—sides. In the example shown in FIG. 1 the cutting tool comprises a plurality of cutters 26*a* configured to be incident to the corner regions 19 of said bands: each cutter presents an cutting edge 26*b* which is shaped as the opening 28 to be formed on the precursor body: as it can be seen from FIG. 4 certain cutting edges are substantially triangular in shape and form triangular apertures 28, while certain cutting edges are quadrangular in shape and form quadrangular apertures.

Figure 9:
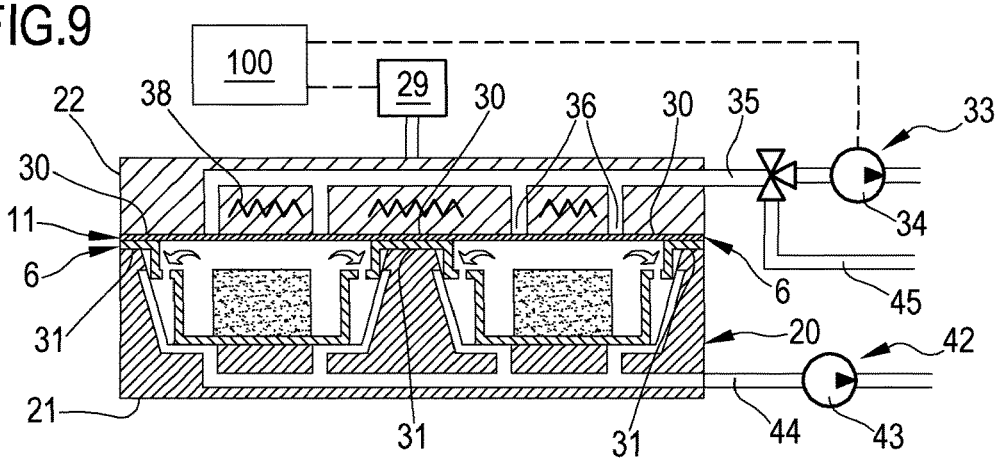
Figure 10:
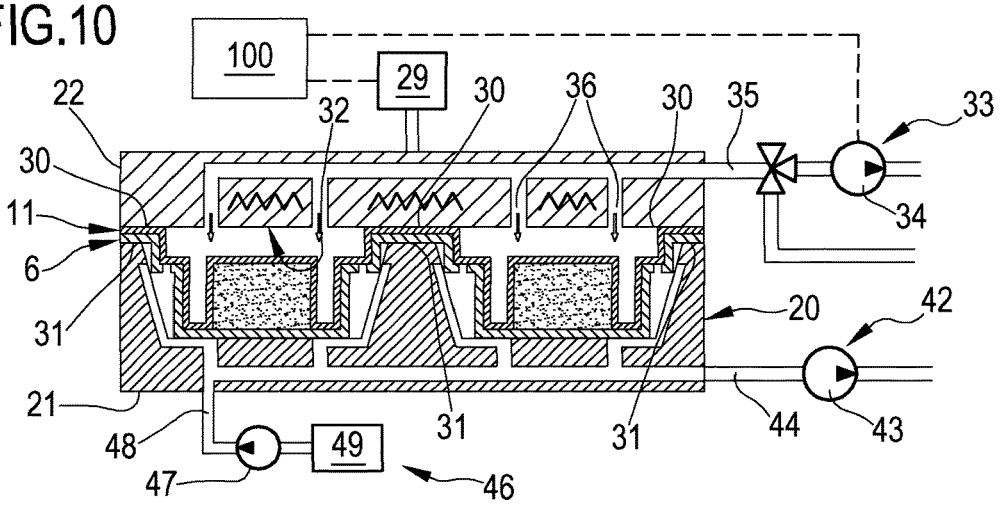
Figure 13:
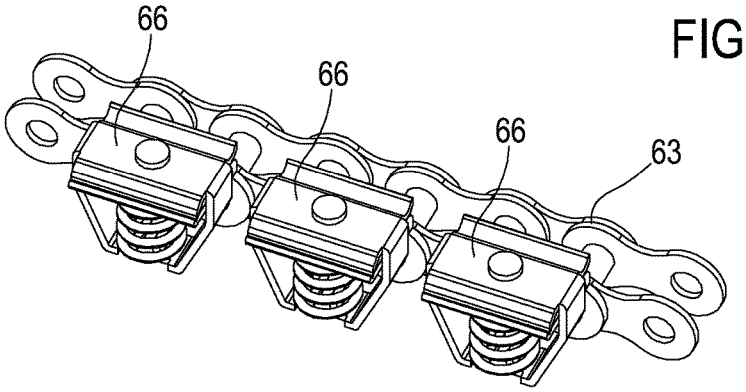
FIG. 13 is a perspective view of grippers carried by a chain which is of the driving assembly associated to the apparatus of any one of FIGS. 1 to 3.
Figure 14:
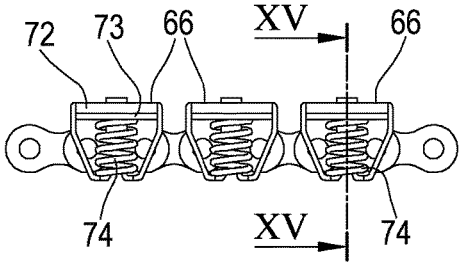
FIG. 14 is a side view of the grippers shown in FIG. 13.
Figure 15:
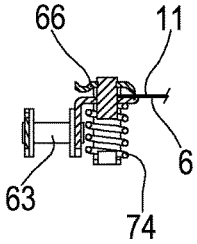
FIG. 15 is a cross section taken along section plane XV-XV represented in FIG. 14.
Figure 16:
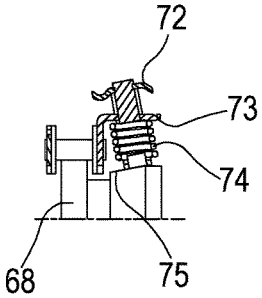
FIG. 16, is a cross section analogous to that of FIG. 15 showing the chain engaging a toothed wheel and the gripper brought in an open position.
Figure 17:
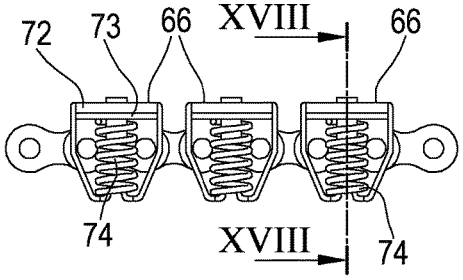
FIG. 17 is a side view of a variant of the grippers which may be used in place of those shown in FIG. 13.
Figure 18:
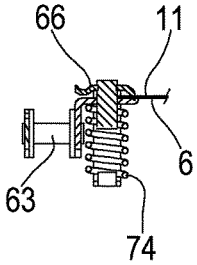
FIG. 18 is a cross section taken along section plane XVIII-XVIII represented in FIG. 17.
Figure 19:
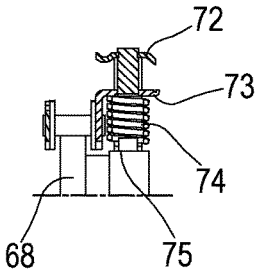
FIG. 19, is a cross section analogous to that of FIG. 18 showing the chain engaging a toothed wheel and the gripper brought in an open position.
Figure 22:
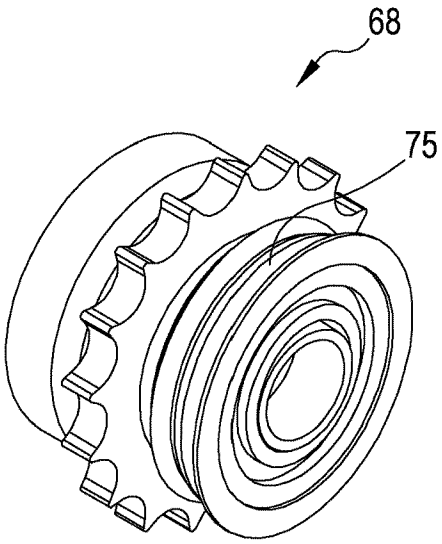
FIG. 22 is a perspective view of the toothed wheel of FIG. 20.
Figure 21:
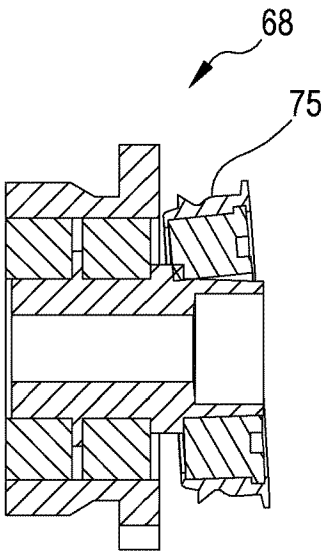
FIG. 21 is an elevation view of the toothed wheel of FIG. 20.
Figure 20:
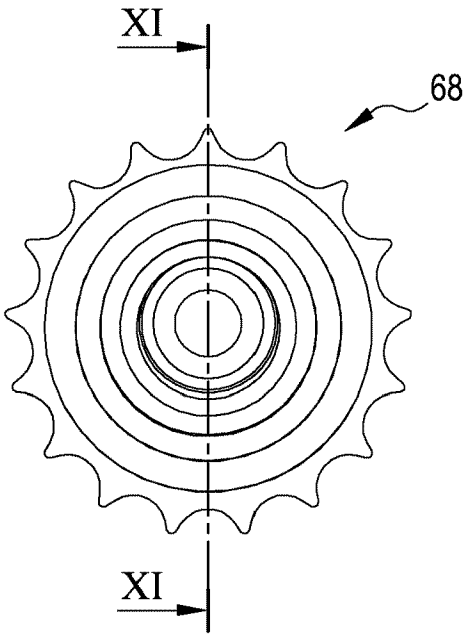
FIG. 20 shows a cross section of a toothed wheel part of the driving assembly according to aspects of the invention.

Going now to a detailed description of the packaging assembly 20 and referring to FIGS. 8-11, it should be noted that the packaging assembly comprises at least one main actuator 29 (which may be a pneumatic, electric, or hydraulic actuator) active on at least one of said upper and lower tools 22, 21 such that the upper and the lower tool are displaced between an open position, where the upper tool 22 is spaced apart from the lower tool 21 and forms a gap which allows positioning of the tray-shaped elements 8 in the seats 21*a* and of the plastic film 11 above the tray-shaped elements, and a closure position, where the upper tool and the lower tool are in close proximity and act one against the other such as to sealingly fix the plastic film above the one or more tray-shaped elements located in the packaging assembly. In practice the material of the plastic film and that of the precursor body are interposed between abutting portions 30 of the upper tool 22 and the corresponding abutting portions 31 of the lower tool 21, as shown in FIGS. 9 and 10. The abutting portions 30 and 31 at least surround the periphery of the top openings of the tray shaped elements 8. Control unit 100 controls the main actuator 29 so as to move the upper and lower tool between the upper and lower positions.

The upper tool comprises means 33 for holding a portion of the plastic film 11 in correspondence of an active surface 32 of the upper tool facing the lower tool. The means for holding 33 may comprise a vacuum source 34, e.g. a vacuum pump, controlled by the control unit 100 and a tubing 35 connected or connectable to the vacuum source and leading to a number of suction apertures 36 present on active surface 32 of the upper tool 22. Alternatively, or in addition, the holding means 33 may include a mechanical holder (for instance comprising pincers configured to grip the plastic film in position). In an other alternative, or in addition, the holding means may comprise a heater capable of heating the active surface of the upper tool, thus warming the plastic film 11, such as to increase stickiness to the active surface 32 of the same plastic film. Yet according to another alternative, or in addition, the holding means may include adhesive portions of the active surface. In a further alternative, or in addition, the holding means may include an electric holder configured to alter the polarity of the active surface of the upper tool so as to create electric forces between said active surface and the plastic film. In an embodiment, the control unit 100 is configured for activating the means for holding, e.g. by activating said vacuum source 34 or by causing a valve 37 to connect the tubing to the vacuum source 34, and causing the active surface to receive and hold said portion of the plastic film in a proper position above the tray-shaped elements located in the packaging assembly.

Going in further detail, it should be noted that the upper tool 22 may present a flat active surface or a dome shaped active surface (this second variant is shown in FIG. 11). Heating means is associated to the upper tool and controlled by the control unit 100 such that the active surface of the lower tool is brought at least to a temperature comprised between 150° C. and 260° C., optionally between 180-240° C., more optionally between 200-220° C. As heating means, electric resistances inside the upper tool 22 or located in correspondence of the active surface 32 may for instance be used.

The lower tool 21 presents a number of base wall portions 39 and a number of side wall portions 40 emerging from respective of said base wall portions to define said number of seats 21*a*. In case the upper tool has a dome shaped active surface, then one or more of the side wall portions in the lower tool may carry at least a protrusion 41 which is positioned and configured such that, when the tray-shaped elements 8 are located in the respective seats 21*a* of the lower tool, each protrusion 41 is inserted into a respective through opening located in one of said cross regions and protrudes above the tray-shaped elements in direction of said dome shaped active surface. In other words, the protrusion, which may comprise a pin, passes through the openings 28 and emerges above the bands of the precursor body in direction of the dome shaped active surface 32 so as to avoid that the plastic film closes the openings 28 before any possible step of gas withdrawal from and/or injection into the cavities of the tray-shaped elements 8. The presence of the protrusion is not strictly necessary as the holding means 33, e.g. applying vacuum to the active surface of the upper tool, may suffice to keep the film apart from the apertures 27, 28 during application of vacuum in the lower tool.

In fact, the apparatus 1 may further comprise a vacuum arrangement 42 connected to the lower tool 21 and configured for removing gas from an interior of said tray-shaped elements; the vacuum arrangement 42 has at least one vacuum source 43 (e.g.: a pump) and at least one evacuation line 44 connecting said through openings 27, 28 to the vacuum source. The control unit 100 may be configured to control the vacuum arrangement 42 to withdraw gas at least when the upper and lower tools are in the closed position. The control unit 100 may also inactivate the holding means 33 of the plastic film 11, for example by inactivating the vacuum pump 33 and/or by connecting the suction apertures 36 to the atmosphere, e.g. via an auxiliary line 45 open to the outside atmosphere and selectively connectable to the apertures 36 by valve 37, such that the plastic film may drape down on the tray and on the product P hosted in each tray (FIG. 10). This together with proper heating of at least portions of the plastic film and/or of the precursor body, e.g. at the bands, causes sealing of the tray-shaped elements and skin packaging of the product P with the plastic film. In case of skin packaging the film may include a gas (e.g.: oxygen) permeable layer which adheres to the product and a gas impermeable layer (e.g.: oxygen impermeable) removably adhering to the gas permeable layer such that—when the tray is in use—the gas impermeable layer may be removed allowing oxygen to get in contact with the product while keeping liquids and solids confined within the packaging by virtue of the presence of the gas permeable layer.

The apparatus may alternatively, or in addition, include a controlled atmosphere arrangement 46 (shown in FIG. 10) connected to the lower tool 21 and configured for injecting a gas stream into the interior of said tray-shaped elements. The controlled atmosphere arrangement comprises at least one injection device 47 (e.g. a pump or an injection valve) and at least one injection line 48 connecting a gas source 49 to the through openings 27, 28 via the injection device 47: the control unit 100 acts on said controlled atmosphere arrangement to inject said stream of gas at least when the upper and lower tools are in said closed position. Also in case of modified atmosphere packaging (MAP), the proper heating of at least portions of the plastic film or of the precursor body bands causes sealing of the tray-shaped elements with the plastic film. In particular, in case of MAP applications, the upper tool may include a heating bar which—after injection of the gas into the cavities of the tray-shaped elements—lowers and abuts against the film portions overlapping the top rim of the tray-shaped elements, to thermally seal the film to said top rim(s). The controlled atmosphere arrangement may be configured to inject gas or gas mixtures including a quantity of one or more of $N_2$, $O_2$ and $CO_2$ which is different from the quantity of these same gases as present in the atmosphere at 20° C. and sea level (1 atmosphere pressure). The control unit 100 may also be configured to control the composition of the modified atmosphere generated inside the packaging assembly. For instance the control unit 100 may regulate the composition of the gas stream injected into the packaging chamber. The gas mixtures injected into the packaging chamber to generate a modified atmosphere may vary depending upon the nature of product P. In general modified atmosphere mixtures include a volumetric quantity of one or more of $N_2$, $O_2$ and $CO_2$ which is different from the quantity of these same gases as present in the atmosphere at 20° C. and sea level (1 atmosphere pressure). If product P is a produce such as meat, poultry, fish, cheese, bakery or pasta the following gas mixtures may be used (quantities are expressed in volume percentages at 20° C., 1 atm of pressure):

Red meats, Poultry skinless: $O_2$=70%, $CO_2$=30%

Poultry with skin on, Cheese, Pasta, Bakery products: $CO_2$=50%, $N_2$=50%

Fish $CO_2$=70%, $N_2$=30% or $CO_2$=40%, $N_2$=30%, $O_2$%=30

Processed meat $CO_2$=30%, $N_2$=70%

In an embodiment the apparatus includes both the vacuum arrangement and the controlled atmosphere arrangement. Furthermore, the control unit 100 may in this case be configured to control said controlled atmosphere arrangement to start injecting said stream of gas either after a prefixed delay from activation of said vacuum arrangement or after a prefixed level of vacuum has been reached inside said interior of the tray-shaped elements.

In accordance with an aspect the control unit is configured to control said controlled atmosphere arrangement to start injecting said stream of gas while said gas withdrawal is still ongoing.

In a further aspect, the control unit is configured to operate the vacuum arrangement for removing gas and create a vacuum level with pressure comprised between 100 and 300 mbar, optionally between 150 and 250 mbar, within said interior of the tray-shaped elements.

Going in further structural aspects, the lower tool 21 has one or more seats 21*a* for receiving the tray-shaped elements 8: each seat 21*a* is delimited by a base wall portion 39 and a side wall portion 40 emerging from the respective base wall portion. In the embodiment shown e.g. in FIGS. 8-11 the evacuation line 44 of the vacuum arrangement leads to a first groove 50 defined in the side wall portion 40 of each seat and to a second grove 51 defined in the base wall portion 39 of each seat; the first and second grooves are obtained in the respective wall portions and are open into the inside of the respective seat 21*a*: the grooves allow proper gas communication between the through openings 27, 28 in the tray-shaped elements and a tubing obtained in the lower tool connecting said grooves to said evacuation line. In a similar manner, the injection line 48 of the controlled atmosphere arrangement 46, if present, leads to the first groove 50 defined in the side wall portion 40 of each seat and to the second grove 51 defined in the base wall portion 39 of each seat; a tubing (which may be the same tubing used by the vacuum arrangement) in the lower tool may be present for connecting said grooves to said injection lines. Alternatively, the injection line may lead directly in correspondence of the apertures 27, 28 or it may lead to nozzles passing through said apertures 27 or 28 such as to avoid that pressure outside the tray-shaped elements is higher that pressure generated inside the tray-shaped elements.

In accordance with aspects of the invention, a driving assembly 60 is associated to the frame 2 and drives the precursor body 6 and the plastic film 11 as it will be described herein below. FIGS. 1-3 schematically show possible alternative embodiments of the driving assembly.

The driving assembly 60 includes a first active portion 61 positioned downstream from the packaging assembly 20 on both sides of the operating path. The first active portion 61 may be configured to grip the two longitudinal side borders of a longitudinal portion of the precursor body which longitudinally extends downstream from the packaging assembly 20 (this is visible in all embodiments of FIGS. 1 to 3E). The driving assembly and particularly the first active portion may contemporaneously engage also the longitudinal side borders of the plastic film 11 as downstream the packaging assembly the plastic film and the precursor body overlap and may have substantially or exactly the same width. In any case the plastic film 11 is at least pulled by the precursor body by virtue of the fact that the plastic film, at the packaging assembly, has been fixed to the precursor body; as mentioned if the plastic film has substantially the same width of the precursor body, the plastic film portion extending downstream the packaging assembly is gripped and pulled by the first active portion 61 together with the precursor body. In certain embodiments (see e.g. FIGS. 1, 2 and 3A), in correspondence of the packaging assembly 20 and preferably also in correspondence of the cutting assembly 26, both the plastic film 11 and precursor body 6 are laterally (i.e. transversally to the machine direction) free from engagement with the first active portion or other driving mechanism. In practice, as it is visible in FIGS. 1, 2 and 3A the longitudinal edges of the plastic film 11 and of the precursor body 6, in correspondence of the packaging assembly 20 and the cutting assembly 26 are left free. This solution allows the plastic film to be exactly sized to match the size of the top openings of the tray-shaped elements 8. Moreover, the absence of any driving portion acting on the side borders of the precursor body at the packaging assembly allows to minimize the size of the longitudinal bands 16 which will form the top rims of the final trays without compromising the efficient sealing of the plastic film.

Alternatively (see e.g. FIGS. 3C and 3D), the first active portion 61 may be configured to grip only the two longitudinal side borders of a longitudinal portion of the plastic film 11. In this case the plastic film 11 would present a width (measured perpendicular to MD) greater than the width of the precursor body: see the cross section of FIG. 3D where it is shown that the plastic film is larger than the underlying precursor body in order to allow grippers associated to the first active portion 61 to engage longitudinal side borders of the plastic film 11 without engaging the longitudinal side borders of the precursor body.

In one variant, see fir. 3A, the first active portion 61 is configured to grip the two longitudinal side borders of a portion of the plastic film 11 which longitudinally extends downstream from the packaging assembly 20 (in this case the first active portion may also grip the precursor body longitudinal side borders).

Figure 3A:
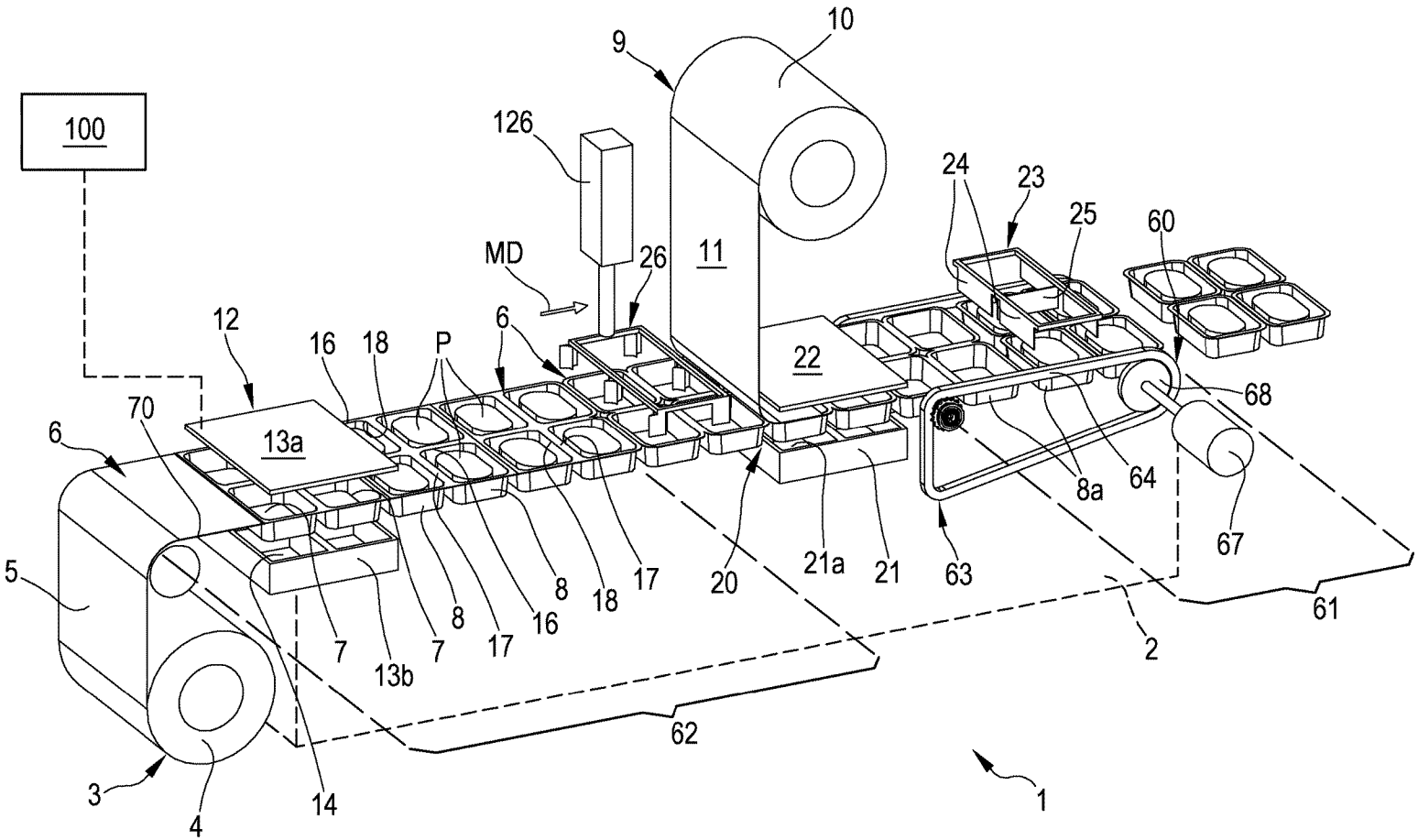
FIG. 3A is a schematic perspective view layout of a third apparatus according to aspects of the invention.
Figure 3B:
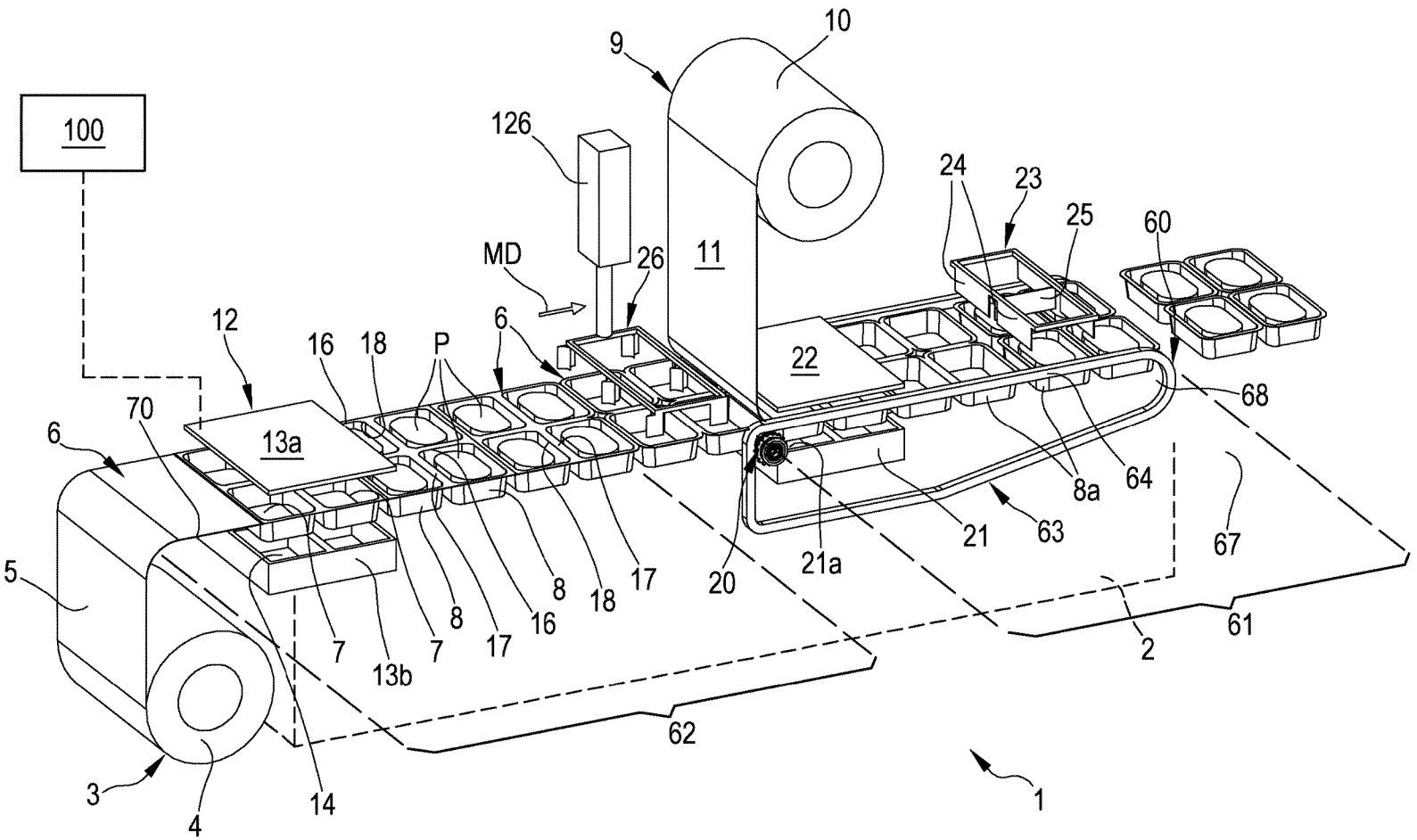
FIG. 3B schematically shows layout of a fourth apparatus according to aspects of the invention.
Figures 3C, 3D:
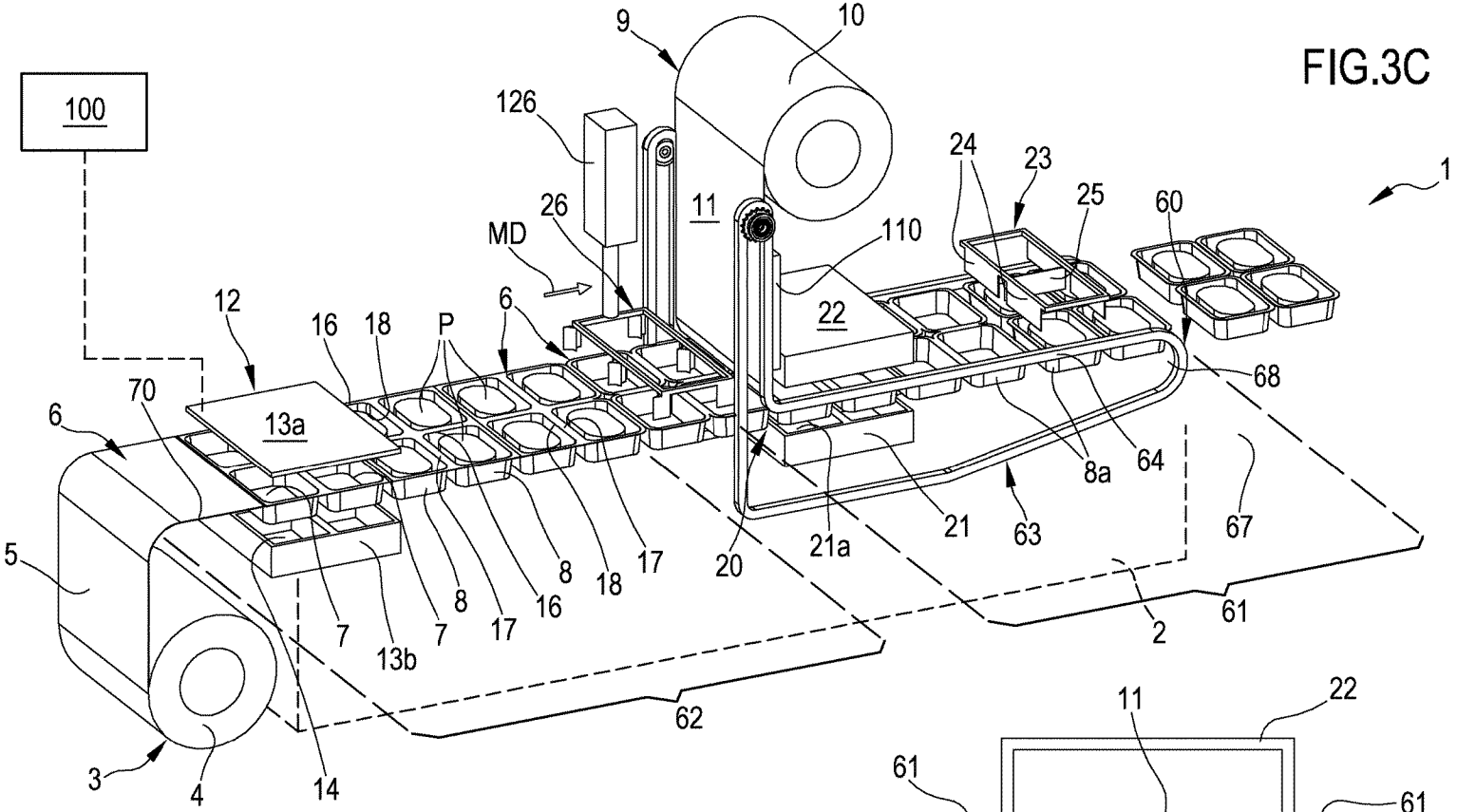
FIG. 3C schematically shows layout of a firth apparatus according to aspects of the invention.
FIG. 3D is a schematic cross section of a portion of the apparatus of FIG. 3C at the exit of the packaging assembly.

In a second variant, see FIG. 3B, the first active portion 61 is configured to grip the two longitudinal side borders of a portion of the plastic film 11 which longitudinally extends inside the packaging assembly and for a tract downstream from the packaging assembly 20. In this case the first active portion preferably only grips the plastic film.

In a third variant (FIG. 3C and FIG. 3D), the first active portion 61 is configured to grip the two longitudinal side borders of a portion of the plastic film 11 which extends from the film supply assembly 9 and longitudinally inside the packaging assembly and for a tract downstream from the packaging assembly 20.

In these last two variants (FIGS. 3B and 3C) the driving assembly and particularly the first active portion preferably does not engage the precursor body 6 that is basically only pulled by the plastic film which, at the packaging assembly, has been fixed to the precursor body.

The first active portion 61 may release the plastic film 11 at or downstream the separating assembly 23 and two side stripes of excess material may then be removed from the plastic film 11. Also note that the apparatus may comprise a pre-warming plate 110 (shown only in FIG. 3C but which could also be present in the other embodiments shown) active downstream supply assembly 10 and positioned immediately upstream the packaging assembly. For instance the pre-warming plate 110 may be located in correspondence of the vertical tract of film 11 extending between the film supply assembly 9 and the packaging assembly 20: the pre-warming plate faces the film sheet and is configure to warm it at a suitable temperature for enhancing film stretchability before the film arrives inside the packaging assembly; this aspect combined with the first active portion 61 gripping the film 11 longitudinal side borders inside the packaging assembly 20 allows to achieve packaging of products vertically protruding out of the cavity of the tray-shaped elements (in such a case a dome shaped upper tool is normally used). In correspondence of both the packaging assembly and the cutting assembly, precursor body 6 is laterally (i.e. transversally to the machine direction) free from engagement with the first active portion or other driving mechanism.

The above three variants allow to minimize if not nullify scrape of the material forming the precursor body. In the variant where also the plastic film is not gripped while within the packaging assembly, allows the plastic film to be exactly sized to match the size of the top openings of the tray-shaped elements 8. Moreover, the absence of any driving portion acting on the side borders of the precursor body at the packaging assembly allows to minimize the size of the longitudinal bands 16 which will form the top rims of the final trays without compromising the efficient sealing of the plastic film. In the variant wherein the plastic film is gripped while within the packaging assembly, there may be some scrap of plastic film material 11, but also the possibility of laterally controlling the plastic film during application of the same to the tray-shaped elements, with the possibility of packaging products P vertically emerging above the tray-shaped elements (in this case with use of a dome shaped upper tool as shown in FIG. 11).

In a further variant, the first active portion may be configured to grip both the longitudinal side borders of the longitudinal portion the plastic film and the longitudinal side borders of the precursor body. More in detail, in accordance with this further variant, as the plastic film and the precursor body exit from the packaging assembly, the first active portion engages the portions of side borders longitudinally extending downstream from the packaging assembly. In this variant too, the driving assembly is configured such that the longitudinal side borders of the precursor body and of the plastic film, in correspondence of the packaging assembly and preferably also of the cutting assembly, are free and not engaged by any part of the driving assembly.

In the example of FIGS. 1 and 2, the driving assembly includes a second active portion 62 positioned between the forming station 12 and the packaging assembly 20 on both sides of the operating path and configured to grip longitudinal side borders of a portion of the precursor body 6 longitudinally extending between the forming station 12 and the packaging assembly 20. In a first variant, shown in FIG. 1, the driving assembly is configured such that the longitudinal side borders of the precursor body, in correspondence of the forming station 12 are laterally engaged by said second active portion 62, while in a second variant, shown in FIG. 2, the driving assembly is configured such that the longitudinal side borders of the precursor body, in correspondence of the forming station 12, are laterally free and not engaged by any part of the driving assembly. The engagement of the driving assembly at the forming station may help in keeping the precursor body in the right position while forming the tray-shaped elements. On the other hand leaving the side borders free may reduce scrap material and still be adequate for certain type of easily deformable materials.

In FIG. 1, the first and second active portions 61 and 62 are, on each side of the frame, part of a same elongated body. In FIG. 2, the first and second active portions are, on each side of the frame, part of two respective elongated bodies. FIG. 3 shows an embodiment wherein the driving assembly has no second active portion but only the first active portions in the variants described above.

Under a constructive point of view, and as shown in FIGS. 13-22, the driving assembly 60 includes at least one elongated driving body 63 (e.g. a driving chain or a driving belt) on each side of the operating path. In the case of FIG. 2 two elongated bodies 63 arte present on each side of the frame 2. Each elongated driving body 63 is mounted to the support frame 2 defining a respective closed path having a driving branch, engaging at least one of the plastic film and elongated body, and a return branch; each driving assembly 60 also includes a plurality of grippers 66 carried by the elongated driving body 63 and configured to grip opposite longitudinal side borders of the precursor body 6 and/or of the plastic film 11 as described above, and at least a motor 67 connected, e.g. via a toothed wheel 68, to the driving body 63 and controlled by the control unit 100. The control unit 100 is configured to operate the motor 67 such as to move the elongated driving body 63 along said closed path, with the driving branch moving according to the machine direction and the return branch moving opposite to the machine direction to close the loop. The elongated body 63 is configured in closed path such that the driving branch continuously comprises a first segment 64 which extends, parallel to the operating path, downstream from the packaging assembly 20: in practice the first active portion 63 described above is defined, on each side of the frame 2, by the gripping elements 66 carried by the first segment 64 which are adapted to grip the side borders of the precursor body and/or of the plastic film portions positioned longitudinally downstream from the packaging assembly.

In the embodiment of FIG. 1 one elongated body 63 is configured in closed path on each side of the frame 2 such that the driving branch of the elongated body continuously comprises a second segment 65 which extends parallel to the operating path at least from downstream of the forming station 12 up to upstream of the cutting tool 26. The gripping elements 66 carried by said second segment 65 are adapted to grip the longitudinal side borders of the precursor body 6 longitudinally extending between the forming station 12 and the packaging assembly 26. In the embodiment of FIG. 2 two elongated bodies are configured in a respective closed path on each side of the frame 2 such that the driving branch of the elongated body continuously comprises the first segment on one of said elongated bodies and, on the other of said elongated bodies, a second segment 65 which extends parallel to the operating path at least from downstream of the forming station 12 up to upstream of the cutting tool 26. The gripping elements 66 carried by said second segment 65 are adapted to grip the longitudinal side borders of the precursor body 6 longitudinally extending between the forming station 12 and the packaging assembly 26. In practice, the second active portion 62 of the driving assembly 60 is defined, on each side of the frame, by the gripping elements 66 carried by said second segment 65 which are adapted to grip the side borders of the precursor body portions positioned longitudinally upstream of the cutting assembly 26.

As mentioned, in FIG. 2 two distinct elongated bodies on each side of the frame 2 are used. By contrast, in the example of FIG. 1, the driving branch of the single elongated body 63 present on each side of the frame 2 continuously comprises a third segment 69 connecting a downstream end of the second segment to an upstream end of the first segment; the third segment 69 extends along a trajectory which is sufficiently apart from the operating path in correspondence of the packaging assembly and optionally of the cutting tool whereby the gripping elements 66 carried by said third segment do not engage the longitudinal side borders of neither the precursor body nor the plastic film at least in correspondence of the packaging assembly, and optionally (as shown in FIG. 1) in correspondence of the cutting tool.

In the examples of FIGS. 1 and 2 the driving branch of the elongated body 63 may continuously comprise a fourth or further segment 70 which extends parallel to the operating path at least from the supply assembly up to upstream of forming station 12. The gripping elements carried by said fourth segment are adapted to grip the longitudinal side borders of the precursor body longitudinally extending between the supply assembly and the forming station. In a variant not shown the fourth segment may be obtained on an elongated body distinct from that carrying the first, or second segments. The second active portion of the driving assembly comprises in the case of FIGS. 1 and 2 also the gripping elements carried by said fourth segment. Finally an optional fifth segment 71 connecting a downstream end of the fourth segment 70 to an upstream end of the second segment 65 may be present: the fifth segment extends along a trajectory which is sufficiently apart from the operating path in correspondence of the forming station 12 (see FIG. 2) whereby the gripping elements 66 carried by said fifth segment 71 do not engage the longitudinal side borders of the precursor body at least in correspondence of the forming station.

In order for the gripper elements 66 to engage/disengage the precursor body 6 and/or from the plastic film 11, each of the gripper elements 66 comprises at least two opposing jaws 72, 73 which are normally kept in closed position e.g. by an elastic element 74. The gripper elements 66 are mounted to the elongated body 63 such that a biasing surface 75 carried for example by toothed wheel 68 pushes the jaws in a open condition allowing to release the precursor body 6 and/or the plastic film 11. Note that the apparatus may include toothed wheels positioned along the closed path of the elongated body to the trajectory of the elongated body and thus of the gripper elements (e.g. to define the third and fifth segments 69 and 71). The toothed wheels comprise the biasing surface 75 which is for example defined by a pulley 76 coaxially mounted on the toothed wheels.

Control Unit 100 of Apparatus 1

The apparatus according to the invention has of at least one control unit.

The control unit 100 (schematically represented in FIG. 1) may comprise a digital processor (CPU) with memory (or memories), an analogical type circuit, or a combination of one or more digital processing units with one or more analogical processing circuits. In the present description and in the claims it is indicated that the control unit 100 is "configured" or "programmed" to execute certain steps: this may be achieved in practice by any means which allow configuring or programming the control unit. For instance, in case of a control unit 100 comprising one or more CPUs, one or more programs are stored in an appropriate memory: the program or programs containing instructions which, when executed by the control unit, cause the control unit 100 to execute the steps described and/or claimed in connection with the control unit. Alternatively, if the control unit 100 is of an analogical type, then the circuitry of the control unit is designed to include circuitry configured, in use, to process electric signals such as to execute the control unit steps herein disclosed.

The control unit may be configured for controlling the apparatus 1 in order to execute any one of the packaging processes described below or claimed in the appended claims. In particular, the control unit 100 may be configured to control the driving assembly, the forming station, the cutting tool and the packaging assembly so as to synchronize the movement of the precursor body in a step by step manner with the forming of the cavities of the tray shaped elements in the forming station, with the forming of the through opening at the cutting tool and with the sealing of the tray-shaped elements at the packaging assembly. The control unit may also operate the vacuum and the controlled atmosphere arrangements if present.

For example, it should be noted that the operation of the apparatus is controlled by control unit 100. The control unit 100 is configured for execution of the following cycle:

commanding the forming station to form said tray-shaped elements into the precursor body coming from the supply assembly in the form of plastic web;

commanding the driving assembly to move in a step by step manner said precursor body and said plastic film such as to sequentially bring in the packaging assembly portions of the precursor body having a prefixed number of tray-shaped elements formed therein and corresponding portions of plastic film;

commanding the cutting tool to act on the precursor body in correspondence of a zone of the predefined path comprised between the web supply assembly and the packaging assembly and form said through opening;

commanding the packaging assembly to pass from the open to the closed position, optionally commanding the vacuum arrangement to remove gas and/or commanding the controlled atmosphere arrangement to inject a gas or a gas mixture, commanding the packaging assembly to tightly fix the plastic film to said tray-shaped elements in the packaging assembly, commanding the separating assembly to transversely, and if needed longitudinally, separate the closed tray-shaped elements and form a number of closed trays.

Once the cycle is complete it is possible to obtain a closed tray of the type shown in FIG. 12 wherein the corners of the plastic film overlap and protrude out of the rounded corners of the top rim of the tray, thus allowing an easy peeling although at the same time minimizing scrap of plastic material.

Processes of Packaging

Processes of packaging in accordance with aspects of the invention are now described.

The following processes may be executed by the apparatus according to any one of the above embodiments and variants under the supervision of control unit 100. In accordance with an aspect of the invention it is the control unit 100 which is controlled and programmed to execute below described processes using an apparatus 1 as described in one of the above embodiments or as claimed in any one of the appended claims.

A process of packaging products (P) according to aspects of the invention includes the following steps.

A plastic precursor body 6 in the form of a plastic web is supplied from roller 4. The precursor body 6 is driven in a machine direction MD along an operating path and is received at a forming station 12 where a number of cavities are formed in the precursor body such that the precursor body comprises:

- one or more longitudinal rows of adjacent tray-shaped elements 8,
- longitudinal bands 16 transversally delimiting each of said rows of tray-shaped elements,
- transverse bands 17 longitudinally delimiting and consecutively joining adjacent tray-shaped elements of the same longitudinal row, the transverse bands and the longitudinal bands delimiting top openings of the tray-shaped elements and crossing each other at a plurality of cross regions.

Downstream the forming station, one or more of said products (P) are manually or automatically loaded into a respective cavity of said tray-shaped elements.

After formation of the tray shaped elements, through openings 27 and/or 28 as described above may be created by cutting tool 26 operating upstream the packaging assembly 20. The openings 27 and/or 28 may be positioned and shaped as already described when describing the cutting tool 26. While the precursor body is moved a plastic film is also supplied such that the plastic film and the precursor body are received at a packaging assembly 20 where the plastic film is fixed to the tray shaped elements 8 to close the top opening of said tray-shaped elements of the precursor body. At this point a vacuum may be created within the cavities of the tray shaped elements, for instance by activating the vacuum arrangement as disclosed herein above. Alternatively or in addition, a controlled atmosphere may be created within the cavities of the tray shaped elements by activating the controlled atmosphere arrangement as disclosed herein above. Thanks to the tight closure and thanks to the openings 27 and/or 28 present in the tray-shaped elements, gas may be injected and/or withdrawn efficiently as desired.

Then, the closed tray-shaped elements proceed to a separation assembly where they are transversely separated thereby forming separated closed trays or groups of trays.

The driving of the precursor body and or of the plastic film may be made in different manners.

In accordance with a first variant of the invention the precursor body is driven along the operating path by gripping longitudinal side borders of the precursor body in correspondence of a portion of the precursor body where the precursor body has already tightly received the plastic film, while leaving free the longitudinal side borders of the precursor body in correspondence of a portion of the precursor body where the fixing of the plastic film to the tray-shaped elements takes place, namely at the packaging assembly. In accordance with this first variant only the precursor body is gripped at side borders thereof, while the plastic film is pulled by the precursor body by virtue of the fact that the plastic film, downstream the packaging assembly, is fixed to the precursor body. If precursor body and plastic film have the same width, then both the precursor body and the plastic film are contemporaneously gripped at side borders thereof downstream the packaging assembly In accordance with a second variant of the invention only the plastic film is directly driven by gripping longitudinal side borders of the plastic film at least in correspondence of a portion of the plastic where the precursor body and the plastic film have been tightly coupled. The longitudinal side borders of the precursor body in correspondence of a portion of the precursor body where the fixing of the plastic film to the tray-shaped elements takes place, namely at the packaging assembly, are left free. The precursor body side borders are also not gripped downstream the packaging assembly and the precursor body is basically pulled by the plastic film only by virtue of the fact that the plastic film, downstream the packaging assembly, is fixed to the precursor body. Note that the plastic film, in a further variant, may also be driven by gripping, exclusively the plastic film and not the precursor body, at the packaging assembly or even upstream the packaging assembly e.g. in correspondence of a tract of film 11 extending between the film supply assembly 9 and the packaging assembly 20. This allows a control of the width of the plastic film and thus gives the possibility of skin packaging a wide variety of products, including products vertically protruding above the contour of the tray-shaped elements.

In accordance with a third variant, the precursor body may be driven along the operating path by gripping longitudinal side borders of both the plastic film and the precursor body in correspondence of a portion of the precursor body and of the plastic film where the precursor body has already tightly received the plastic film (namely downstream the packaging assembly). The longitudinal side borders of the precursor body in correspondence of a portion of the precursor body where the fixing of the plastic film to the tray-shaped elements takes place, namely at the packaging assembly, are left free from gripping.

In accordance with a fourth variant, which may be combined with any one of the three variants disclosed herein above in connection with the process for driving the precursor body, driving the precursor body comprises gripping longitudinal side borders of the precursor body in correspondence of a portion where the precursor body has not yet received the formation of the through openings, while leaving free the longitudinal side borders of the precursor body in correspondence of a portion of the precursor body where the formation of the through openings takes place (i.e. at the cutting tool 26).

In accordance with a fifth variant, which may be combined with any one of the four variants disclosed herein above in connection with the process for driving the precursor body, driving the precursor body comprises gripping longitudinal side borders of the precursor body in correspondence of a portion where the precursor body is still in the form of a plastic web before formation of the cavities, while leaving free the longitudinal side borders of the precursor body in correspondence of a portion of the precursor body where the formation of the cavities takes place (i.e. at the forming station 12).

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and the scope of the appended claims.

For instance, the specific nature of the actuators described is exemplificative and alternative types of actuators may be used provided the type of motion imposed to the mobile parts on which said actuators are operating is the same. Also note that although the described embodiments show a single packaging assembly, multiple packaging assemblies may be used in parallel, in order to optimize productivity.

Figure 3E:
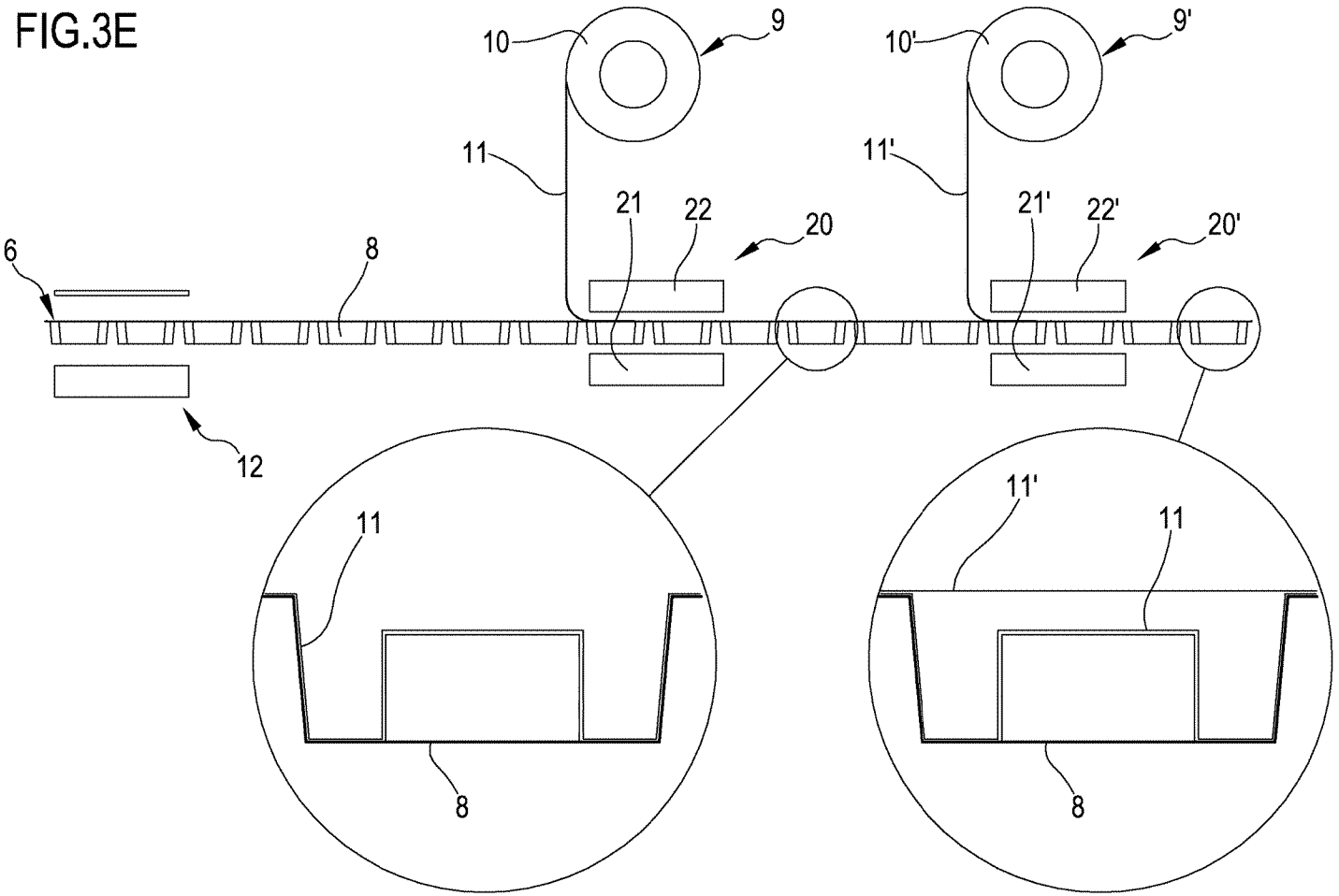
FIG. 3E schematically shows a layout of a sixth apparatus according to aspects of the invention.
Figure 4:
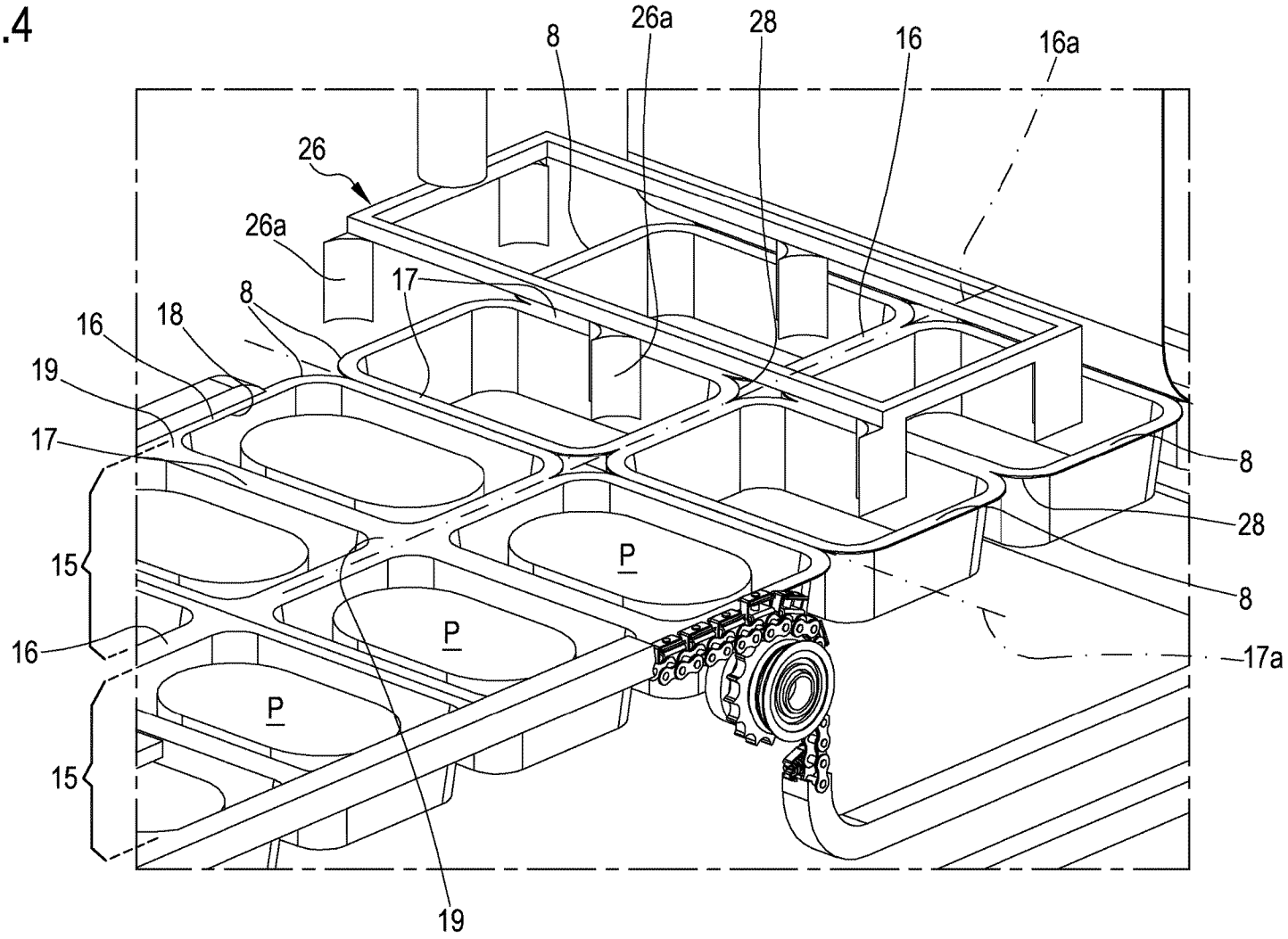
FIG. 4 is an enlarged view of a particular of the apparatus shown in FIG. 1.

Furthermore, as shown schematically in FIG. 3E, the apparatus 1 may provide for application of a second plastic film 11' at a second packaging assembly 20' operating downstream packaging assembly 20 (referred to in this case as first packaging assembly). For instance the first film 11 may be applied to form a skin above the products P contained inside the tray-shaped elements. Then the tray-shaped elements proceed to a second packaging assembly 21' having an upper and a lower tool 22', 21'. A second film supply assembly 9' provide second film 11 which may be applied on top of the tray shaped elements to create:

- a lid with normal atmosphere between the second film 11' and the first film 11;
- a lid with modified atmosphere between the second film 11' and the first film 11;
- a further skin formed by second film 11' and first film 11.

Note that the second film supply assembly and the second packaging assembly may have the same structure and working respectively of film supply assembly 9 (first film supply assembly) and packaging assembly 20 (first packaging assembly) and are thus not described again.

Also note that a second cutting tool, e.g. identical to cutting tool 26 may be present and be active on the tray-shaped elements which have received film 11 but which have not received the second plastic film 11' further apertures analogous to apertures 27 or 28 that may have been closed by application of plastic film 11. The second cutting tool would operate downstream the packaging assembly 20 but upstream, preferably immediately upstream, the second packaging assembly 20'.

The invention claimed is:

1. An apparatus for packaging a product (P) in a tray said apparatus comprising:

- a support frame defining an operating path;
- a web supply assembly associated to the support frame and configured to supply a plastic precursor body in the form of a plastic web;
- a driving assembly carried by the support frame and configured for moving at least the precursor body in a machine direction (MD) along the operating path;
- a forming station positioned on the operating path and configured to receive the precursor body in said form of plastic web and form into it a number of cavities such that, downstream from the forming station, the precursor body comprises:
  - one or more longitudinal rows of adjacent tray-shaped elements,
  - longitudinal bands transversally delimiting each row of tray-shaped elements,
  - transverse bands longitudinally delimiting and consecutively joining adjacent tray-shaped elements of a same longitudinal row, the transverse bands and the longitudinal bands also delimiting top openings of the tray-shaped elements and crossing each other at a plurality of cross regions; and
- a film supply assembly configured to supply a plastic film,
- a packaging assembly also positioned along said operating path and configured to receive said plastic film and said precursor body, wherein the packaging assembly is also configured for tightly fixing the plastic film to close the top opening of said tray-shaped elements and includes:
  - a lower tool comprising a prefixed number of seats each designed for receiving at least one of said tray-shaped elements, and
  - an upper tool facing the lower tool and configured for cooperating with the lower tool to fix said plastic film to at least one tray-shaped element positioned in said seat and sealingly close the respective top opening forming one or more closed tray-shaped elements;
- a separating assembly positioned along said path downstream from the packaging assembly and configured for at least transversely separating the closed tray-shaped elements and form closed trays;
- a cutting tool acting on the precursor body in correspondence of a zone of the operating path comprised between the web supply assembly and the packaging assembly, the cutting tool being configured for forming a through opening located in correspondence of at least one of:
  - a side wall of each of said tray-shaped elements and
  - a plurality of said cross regions between the longitudinal and the transverse bands; and
- a control unit configured and connected to operate at least said driving assembly, said forming station, said packaging assembly and said cutting tool.

2. The apparatus of claim 1 wherein the forming station is configured for forming said plastic precursor body with two or more parallel rows of tray-shaped elements, wherein:

- each of said tray-shaped elements has a substantially rectangular top opening defined by two longitudinal side walls and two transverse side walls of the tray-shaped elements, and
- the transverse bands perpendicularly cross the longitudinal bands delimiting said rectangular top openings such that said cross regions are located in correspondence of corner zones of the tray-shaped elements.

3. The apparatus of claim 1 wherein the cutting tool is positioned for acting on said plastic precursor body and is configured for forming said through opening at a plurality of said cross regions, further wherein the cutting tool is configured to shape said through opening in the form of a cutout portion removed from the plastic precursor body, wherein the cutting tool is configured for forming each cutout portion by removing a part of a transverse band in correspondence of a median line between two longitudinally adjacent tray-shaped elements of a same row.

4. The apparatus of claim 3 wherein the cutting tool is positioned immediately upstream the packaging assembly and is configured such that:

each of said cutout portions is symmetrically located between two adjacent tray-shaped supports, and each of said cutout portions is in the shape of one of:

a triangular aperture delimited by three—straight or arc shaped—sides, and a quadrangular aperture delimited by four—straight or arc shaped—sides.

5. The apparatus of claim 1 wherein the packaging assembly comprises at least one main actuator operated by the control unit and active on at least one of said upper and lower tools, the control unit being configured to operate the main actuator such that the upper and the lower tool are displaced between an open position, where the upper tool is spaced apart from the lower tool and forms a gap which allows positioning of the tray-shaped elements in the seats and of the plastic film above the tray-shaped elements, and a closure position, where the upper tool and the lower tool are in close proximity and act one against the other such as to sealingly fix the plastic film above the one or more tray-shaped elements located in the packaging assembly.

6. The apparatus of claim 1 wherein the upper tool comprises means for holding a portion of the plastic film in correspondence of an active surface of the upper tool facing the lower tool, optionally wherein said means for holding comprises a vacuum source controlled by the control unit, the control unit being configured for activating the means for holding and causing the active surface to receive and hold said portion of the plastic film, and wherein the upper tool presents a flat active or dome shaped surface facing the lower tool and configured for receiving a portion of the plastic film that needs to be fixed onto the tray-shaped elements hosted in the lower tool, and wherein heating means is associated to the upper tool and controlled by the control unit, the control unit being configured for controlling the heating means such that the active surface of the upper tool is brought at least to a temperature comprised between 150° C. and 260° C., optionally between 180-240° C., more optionally between 200-220° C.

7. The apparatus of claim 5 wherein said lower tool presents a number of base wall portions and a number of side wall portions emerging from respective of said base wall portions to define said number of seats and wherein one of said side wall portions carries at least a protrusion which is positioned and configured such that, when the tray-shaped elements are positioned in the respective seats of the lower tool, each protrusion is inserted into a respective through opening located in one of said cross regions and protrudes above the tray-shaped elements in direction of said dome shaped active surface.

8. The apparatus of claim 5 further comprising at least one of:

a vacuum arrangement connected to the lower tool and configured for removing gas from an interior of said tray-shaped elements, the vacuum arrangement comprising at least one vacuum source and at least one evacuation line connecting said through opening to the vacuum source, said control unit being further configured to control the vacuum arrangement to withdraw gas at least when the upper and lower tools are in said closed position; and a controlled atmosphere arrangement connected to the lower tool and configured for injecting a gas stream into the interior of said tray-shaped elements, the controlled atmosphere arrangement comprising at least one injection device and at least one injection line connecting the through opening to the injection device, said control unit being further configured to control said controlled atmosphere arrangement to inject said stream of gas at least when the upper and lower tools are in said closed position;

wherein the controlled atmosphere arrangement is configured to inject gas or gas mixtures including a quantity of one or more of $N_2$, $O_2$ and $CO_2$ which is different from the quantity of these same gases as present in the atmosphere at 20° C. and sea level (1 atmosphere pressure).

9. The apparatus of claim 8, wherein each of said seats is delimited by a base wall portion and a side wall portion emerging from the respective base wall portion and wherein the at least one evacuation line and/or at least one injection line lead to:

a first groove defined in the side wall portion of each seat and opening to the inside of said seat, and/or a second grove defined in the base wall portion of each seat and opening to the inside of said seat.

10. The apparatus of claim 1 wherein the driving assembly includes a first active portion positioned downstream from the packaging assembly on both sides of the operating path and configured to grip longitudinal side borders of a longitudinal portion of at least one of the precursor body and of the plastic film, said gripped longitudinal portion longitudinally extending downstream from the packaging assembly, wherein the driving assembly is configured such that the longitudinal side borders of the precursor body and of the plastic film, in correspondence of the packaging assembly, are free and not engaged by any part of the driving assembly.

11. The apparatus according to claim 10 wherein the driving assembly includes a first active portion positioned downstream from the packaging assembly on both sides of the operating path and configured to grip longitudinal side borders of a longitudinal portion of only the precursor body said longitudinal portion longitudinally extending downstream from the packaging assembly, wherein the driving assembly is configured such that the longitudinal side borders of the precursor body and of the plastic film, in correspondence of the packaging assembly, are free and not engaged by any part of the driving assembly; optionally the longitudinal side borders of the precursor body, in correspondence of the cutting tool, being free and not engaged by any part of the driving assembly; or the driving assembly includes a first active portion positioned downstream from the packaging assembly on both sides of the operating path and configured to grip longitudinal side borders of a longitudinal portion only of the plastic film, said longitudinal portion longitudinally extending downstream from the packaging assembly, wherein the driving assembly is configured such that the longitudinal side borders of the precursor body and of the plastic film, in correspondence of the packaging assembly, are free and not engaged by any part of the driving assembly; optionally the longitudinal side borders of the precursor body, in correspondence of the cutting tool, being free and not engaged by any part of the driving assembly; or the driving assembly includes a first active portion positioned downstream from the packaging assembly on both sides of the operating path and configured to grip longitudinal side borders of a longitudinal portion of the plastic film and of the precursor body longitudinally extending downstream from the packaging assembly, wherein the driving assembly is configured such that the longitudinal side borders of the precursor body and of the plastic film, in correspondence of the packaging assembly, are free and not engaged by any part of the driving assembly; optionally the longitudinal side borders of the precursor body, in correspondence of the cutting tool, being free and not engaged by any part of the driving assembly; or the driving assembly includes a first active portion positioned on both sides of the operating path and configured to grip:

longitudinal side borders of a longitudinal portion only of the plastic film longitudinally extending downstream from the packaging assembly, longitudinal side borders of a longitudinal portion of the plastic film longitudinally in correspondence of the packaging assembly, and optionally longitudinal side borders of a longitudinal portion of the plastic film extending between the film supply assembly and the packaging assembly, wherein the driving assembly is configured such that the longitudinal side borders of the precursor body, in correspondence of the packaging assembly, are free and not engaged by any part of the driving assembly; optionally the longitudinal side borders of the precursor body, in correspondence of the cutting tool, being free and not engaged by any part of the driving assembly.

12. The apparatus of claim 11, wherein the first active portion is configured to grip longitudinal side borders of the longitudinal portion of the precursor body, and wherein:

the driving assembly includes a second active portion positioned between the forming station and the packaging assembly on both sides of the operating path and configured to grip longitudinal side borders of a portion of the precursor body longitudinally extending between the forming station and the packaging assembly, wherein the driving assembly is configured such that the longitudinal side borders of the precursor body, in correspondence of the forming station are free and not engaged by any part of the driving assembly; or the driving assembly includes a second active portion positioned between the supply assembly and the packaging assembly on both sides of the operating path and configured to grip the side borders of a portion of the precursor body longitudinally extending from the forming station, included, and the packaging assembly.

13. The apparatus according to claim 11, wherein the driving assembly includes at least one elongated driving body on each side of the operating path, wherein each elongated driving body is mounted to the support frame defining a closed path having a driving branch and a return branch;

a plurality of grippers carried by the elongated driving body and configured to grip opposite longitudinal side borders of the precursor body and/or of the plastic film; and at least a motor connected to the driving body and controlled by the control unit, this latter being configured to operate the motor such as to move the elongated driving body along said closed path, with the driving branch moving according to the machine direction and the return branch moving opposite to the machine direction;

wherein the elongated body is configured in said closed path such that the driving branch of the elongated body continuously comprises a first segment which extends according to one of the following configurations:

parallel to the operating path downstream from the packaging assembly;

parallel to the operating path at the packaging assembly and downstream from the packaging assembly;

transverse to the operating path, between the film supply assembly and the packaging assembly and, parallel to the operating path, at the packaging assembly and downstream from the packaging assembly;

wherein the gripping elements carried by said first segment are adapted to grip the side borders of the precursor body longitudinally downstream from the packaging assembly and/or are adapted to grip the side borders of the plastic film; and wherein the first active portion of the driving assembly comprises the gripping elements carried by said first segment.

14. The apparatus of claim 13 wherein the elongated body is configured in said closed path such that the driving branch of the elongated body continuously comprises a second segment which extends parallel to the operating path at least from downstream of the forming station up to upstream of the cutting tool wherein the gripping elements carried by said second segment are adapted to grip the longitudinal side borders of the precursor body longitudinally extending between the forming station and the packaging assembly; wherein the second active portion of the driving assembly comprises the gripping elements carried by said second segment; and/or wherein driving branch of the elongated body continuously comprises a third segment connecting a downstream end of the second segment to an upstream end of the first segment, the third segment extending along a trajectory which is sufficiently apart from the operating path in correspondence of the packaging assembly and optionally of the cutting tool whereby the gripping elements carried by said third segment do not engage the longitudinal side borders of neither the precursor body nor the plastic film at least in correspondence of the packaging assembly, and optionally in correspondence of the cutting tool.

15. The apparatus of claim 14 wherein driving branch of the elongated body continuously comprises:

a fourth segment which extends parallel to the operating path at least from the supply assembly up to upstream of forming station wherein the gripping elements carried by said fourth segment are adapted to grip the longitudinal side borders of the precursor body longitudinally extending between the supply assembly and the forming station;

wherein the second active portion of the driving assembly comprises the gripping elements carried by said fourth segment;

and an optional fifth segment connecting a downstream end of the fourth segment to an upstream end of the second segment, the fifth segment extending along a trajectory which is sufficiently apart from the operating path in correspondence of the forming station whereby the gripping elements carried by said fifth segment do not engage the longitudinal side borders of the precursor body at least in correspondence of the forming station.

16. Apparatus according to claim 1 wherein the control unit is configured for execution of the following cycle:

commanding the forming station to form said tray-shaped elements into the precursor body coming from the supply assembly in the form of plastic web;

commanding the driving assembly to move in a step by step manner said precursor body such as to sequentially bring in the packaging assembly portions of the precursor body having a prefixed number of tray-shaped elements formed therein;

commanding the cutting tool to act on the precursor body in correspondence of a zone of the operating path comprised between the web supply assembly and the packaging assembly and form said through opening;

commanding the packaging assembly to pass from the open to the closed position, optionally commanding the vacuum arrangement to remove gas and/or commanding the controlled atmosphere arrangement to inject a gas or a gas mixture, commanding the packaging assembly to tightly fix the plastic film to said tray-shaped elements in the packaging assembly commanding the separating assembly to transversely separate the closed tray-shaped elements and form a number of closed trays.

17. A process of packaging products (P), the process comprising the following steps:

supplying, by a web supply assembly, a plastic precursor body in the form of a plastic web;

driving at least the precursor body in a machine direction along an operating path;

receiving the precursor body in said form of plastic web and forming into it a number of cavities such that the precursor body comprises:

one or more longitudinal rows of adjacent tray-shaped elements, longitudinal bands transversally delimiting each of said rows of tray-shaped elements, transverse bands longitudinally delimiting and consecutively joining adjacent tray-shaped elements of a same longitudinal row, the transverse bands and the longitudinal bands delimiting top openings of the tray-shaped elements and crossing each other at a plurality of cross regions;

loading one or more of said products (P) into a respective cavity of said tray-shaped elements;

supplying a plastic film;

tightly fixing, by a packaging assembly, the plastic film to close the top opening of said tray-shaped elements of the precursor body;

transversely separating the closed tray-shaped elements thereby forming separated closed trays or groups of trays;

before tightly fixing the plastic film to the tray-shaped elements, forming, using a cutting tool, a through opening located in correspondence of at least one of:

a side wall of each of said tray-shaped elements, and a plurality of said cross regions of between the longitudinal and the transverse bands, wherein the cutting tool is configured to form the through opening in a zone of the operating path between the web supply assembly and the packaging assembly.

18. The process of claim 17, comprising forming said plastic precursor body with two or more parallel rows of tray-shaped elements, wherein:

each of said tray-shaped elements has a substantially rectangular top opening defined by two longitudinal side walls and two transverse side walls of the tray-shaped elements, and the transverse bands perpendicularly cross the longitudinal bands delimiting said rectangular top openings such that said cross regions are located in correspondence of corner zones of the tray-shaped elements; and wherein forming a trough opening comprises forming said through opening at a plurality of said cross regions.

19. The process of claim 17 wherein said through opening is shaped in the form of a cutout portion removed from the plastic precursor body, by removing a part of a transverse band in correspondence of a median line between two longitudinally adjacent tray-shaped elements of a same row, and each of said cutout portions is symmetrically located between two adjacent tray-shaped supports, and each of said cutout portions is in the shape of one of: a triangular aperture delimited by three—straight or arc shaped—sides, and a quadrangular aperture delimited by four—straight or arc shaped—sides.

20. The process of claim 17 comprising:

holding a portion of the plastic film in correspondence and above of a corresponding tray-shaped element, heating the portion of plastic film at least to a temperature comprised between 150° C. and 260° C., optionally between 180-240° C., more optionally between 200-220° C., removing gas from an interior of said tray-shaped elements; and/or injecting a gas or a gas mixture into the interior of said tray-shaped elements, to form controlled atmosphere inside said tray-shaped elements;

wherein the gas or gas mixtures includes a quantity of one or more of N2, O2 and CO2 which is different from the quantity of these same gases as present in the atmosphere at 20° C. and sea level (1 atmosphere pressure)

tightly fixing the plastic film to the respective tray shaped element.

21. The process of claim 17 wherein driving the precursor body comprises:

gripping longitudinal side borders the of precursor body in correspondence of a portion where the precursor body has fixedly received the plastic film, while leaving free the longitudinal side borders of the precursor body in correspondence of a portion of the precursor body where the fixing of the plastic film to the tray-shaped elements, and optionally where the formation of the through openings, takes place; or gripping longitudinal side borders only the of plastic film in correspondence of a portion where the precursor body has fixedly received the plastic film, while leaving free the longitudinal side borders of the precursor body in correspondence of a portion of the precursor body where the fixing of the plastic film to the tray-shaped elements, and optionally where the formation of the through openings, takes place, wherein the plastic film has a width measured perpendicular to the machine direction greater than the width of the precursor body; or gripping longitudinal side borders of the plastic film in correspondence of:

a portion of the plastic film longitudinally extending where the precursor body has fixedly received the plastic film, a portion of the plastic film longitudinally extending at the packaging assembly and optionally a portion of the plastic film longitudinally extending between the film supply and the plastic film fixing to the precursor body, while leaving free the longitudinal side borders of the precursor body in correspondence of a portion of the precursor body where the fixing of the plastic film to the tray-shaped elements, and optionally where the formation of the through openings, takes place, wherein the plastic film has a width measured perpendicular to the machine direction greater than the width of the precursor body; or gripping longitudinal side borders the of precursor body and of the plastic film in correspondence of a portion where the precursor body has fixedly received the plastic film, while leaving free the longitudinal side borders of the precursor body in correspondence of a portion of the precursor body where the fixing of the plastic film to the tray-shaped elements, and optionally where the formation of the through openings, takes place.

22. The process of claim 17 wherein driving the precursor body comprises gripping longitudinal side borders the of precursor body in correspondence of a portion where the precursor body has not yet received the formation of the though openings, while leaving free the longitudinal side borders of the precursor body in correspondence of a portion of the precursor body where the formation of the through openings takes place; and/or wherein driving the precursor body comprises gripping longitudinal side borders the of precursor body in correspondence of a portion where the precursor body is still in the form of a plastic web before formation of the cavities, while leaving free the longitudinal side borders of the precursor body in correspondence of a portion of the precursor body where the formation of the cavities takes place.

23. The process of claim 17 wherein the through openings in the side wall of each of said tray-shaped elements are created—after formation of said number of cavities and definition of the adjacent tray shaped elements in the precursor body—by the cutting tool.

24. The process of claim 17 wherein the through openings in the plurality of said cross regions between the longitudinal and the transverse bands are created—after formation of said number of cavities and definition of the adjacent tray shaped elements in the precursor body—by the cutting tool.

* * * * *